US009031246B2

(12) United States Patent
Burnett

(10) Patent No.: US 9,031,246 B2
(45) Date of Patent: May 12, 2015

(54) CALIBRATION SYSTEM WITH CLAMPING SYSTEM

(75) Inventor: Gregory C. Burnett, Northfield, MN (US)

(73) Assignee: AliphCom, San Francisco, CA (US)

( * ) Notice: Subject to any disclaimer, the term of this patent is extended or adjusted under 35 U.S.C. 154(b) by 399 days.

(21) Appl. No.: 13/209,047

(22) Filed: Aug. 12, 2011

(65) Prior Publication Data

US 2012/0300952 A1 Nov. 29, 2012

Related U.S. Application Data

(63) Continuation-in-part of application No. 13/069,244, filed on Mar. 22, 2011.

(60) Provisional application No. 61/373,071, filed on Aug. 12, 2010.

(51) Int. Cl.

| | |
|---|---|
| ***H04R 29/00*** | (2006.01) |
| *H04R 5/033* | (2006.01) |
| *H04R 1/08* | (2006.01) |

(52) U.S. Cl.

CPC ..... *H04R 29/004* (2013.01); *H04R 5/033* (2013.01); *H04R 1/08* (2013.01)

(58) Field of Classification Search

USPC ..... 381/92, 380, 58, 59

See application file for complete search history.

(56) References Cited

U.S. PATENT DOCUMENTS

| | | | | |
|---|---|---|---|---|
| 2,806,544 | A | 9/1957 | Witchey | |
| 4,002,862 | A | 1/1977 | Turlais | |
| H0000413 | H * | 1/1988 | Lelie | 381/58 |
| 4,924,707 | A | 5/1990 | Kliesch | |
| 4,948,552 | A | 8/1990 | Mollot et al. | |
| 5,105,822 | A | 4/1992 | Stevens et al. | |
| 5,125,260 | A | 6/1992 | Hedeen | |
| 5,410,920 | A | 5/1995 | Westwick | |
| 5,567,863 | A | 10/1996 | Larson et al. | |
| 6,061,456 | A | 5/2000 | Andrea et al. | |

(Continued)

FOREIGN PATENT DOCUMENTS

| | | |
|---|---|---|
| DE | 19623715 | 10/1997 |
| EP | 1725073 A2 | 11/2006 |

OTHER PUBLICATIONS

Phan Le, Uspto Non-Final Office Action, Application No, 13/069,244, Date of Mailing Jun. 17, 2014. 1.

(Continued)

*Primary Examiner* — Duc Nguyen
*Assistant Examiner* — Phan Le
(74) *Attorney, Agent, or Firm* — Kokka & Backus, PC

(57) ABSTRACT

Systems and methods are described for clamping a headset in a calibration system using a clamp system that includes a clamp, platform, and one or more spindles (e.g., cushion spindles) to minimize or eliminate issues associated with positioning of headsets. The clamp system comprises a mount having a receptacle. When a device is introduced to the mount the receptacle receives at least a portion of a device. The clamp system includes a clamp attached to the mount and having a first arm rotateably coupled to a second arm that controls the first arm between an open position and a closed position. A platform and at least one spindle are connected to the first arm. When the device is present in the receptacle and the first arm is in the closed position the spindle contacts the device and seats or secures the device in the receptacle.

16 Claims, 29 Drawing Sheets

(56) References Cited

U.S. PATENT DOCUMENTS

| | | | |
|---|---|---|---|
| 6,134,968 | A | 10/2000 | Kunze, Jr. et al. |
| 6,148,672 | A | 11/2000 | Cawley et al. |
| 6,705,319 | B1 | 3/2004 | Wodicka et al. |
| 7,246,058 | B2 | 7/2007 | Burnett |
| 7,644,734 | B2 | 1/2010 | Palmer |
| 2006/0147054 | A1 | 7/2006 | Buck et al. |
| 2006/0262950 | A1 | 11/2006 | Burns |
| 2008/0044002 | A1 | 2/2008 | Bevirt et al. |
| 2008/0152186 | A1 | 6/2008 | Crowley |
| 2009/0158850 | A1 | 6/2009 | Alleyne et al. |
| 2009/0299742 | A1 | 12/2009 | Toman et al. |
| 2012/0106749 | A1 | 5/2012 | Buck et al. |

OTHER PUBLICATIONS

Phan Le, USPTO Applicant-Initiated Interview Summary, U.S. Appl. No. 13/069,244, Date of Mailing Apr. 11, 2014.

Phan Le, USPTO Final Office Action, U.S. Appl. No. 13/069,244, Date of Mailing Dec. 13, 2013.

Phan Le, USPTO Applicant-Initiated Interview Summary, U.S. Appl. No, 13/069,244, Date of Mailing Nov. 8, 2013.

Sean H. Nguyen, USPTO Final Office Action, U.S Appl. No. 13/069,264, Date of Mailing May 7, 2014.

Sean H. Nguyen, USPTO Final Office Action, U.S Appl. No. 13/069,264, Date of Mailing Aug. 5, 2013.

Phan Le, USPTO Non-Final Office Action, U.S Appl. No. 13/069,275, Date of Mailing Jun. 23, 2014.

Phan Le, USPTO Applicant-Initiated Interview Summary, Application No. 13/069,275, Date of Mailing Apr, 11, 2014.

Phan Le, USPTO Final Office Action, U.S. Appl. No. 13/069,275, Date of Mailing Dec. 13, 2013.

Phan Le, USPTO Applicant-Initiated Interview Summary, U.S. Appl. No. 13/069,275, Date of Mailing Nov. 12, 2013.

Phan Le, USPTO Non-Final Office Action, Application No, 13/069,275, Date of Mailing May 14, 2013.

* cited by examiner 1410 1420 1430

| | A (cm) | B (cm) | C (cm) | D (cm) | E (cm) | Total (cm) | Samp (cm) | Comments |
|---|---|---|---|---|---|---|---|---|
| 1 | 48.1 | 16.8 | 48.1 | 27.7 | 27.7 | 170.8 | 57.1 | Best overall, no disturbances and calibration good to Nyquist |
| 2 | 48.1 | 16.8 | 48.1 | 0.0 | 0.0 | 114.2 | 57.1 | Very good, tiny disturbances near 2 kHz |
| 3 | 48.1 | 16.8 | 27.7 | 0.0 | 0.0 | 93.8 | 57.1 | Good, small disturbances at 2 kHz and 600-700 Hz |
| 4 | 27.7 | 16.8 | 48.1 | 27.7 | 0.0 | 122.1 | 36.7 | Good, some degradation above 3.5 kHz |
| 5 | 27.7 | 16.8 | 48.1 | 0.0 | 0.0 | 93.8 | 36.7 | Good, some degradation above 3.5 kHz and disturbances near 2 kHz |
| 6 | 27.7 | 16.8 | 27.7 | 0.0 | 0.0 | 73.4 | 36.7 | Ok, degraded above 3.5 kHz and disturbances at 600-700 Hz and 2 kHz |
| 7 | 0.0 | 16.8 | 48.1 | 27.7 | 0.0 | 93.8 | 8.4 | Ok, degraded above 3 kHz, small disturbances near 2 kHz |
| 8 | 0.0 | 16.8 | 48.1 | 0.0 | 0.0 | 65.5 | 8.4 | Ok, degraded above 3 kHz, small disturbances near 2 kHz |
| 9 | 0.0 | 16.8 | 27.7 | 0.0 | 0.0 | 45.1 | 8.4 | Ok, degraded above 3 kHz, small disturbances near 650 Hz and 2 kHz |
| 10 | 15.2 | 16.8 | 27.7 | 0.0 | 0.0 | 59.7 | 24.2 | Ok, degraded above 3.3 kHz and disturbances at 600-700 Hz and 2 kHz |

1400

FIG. 29

CALIBRATION SYSTEM WITH CLAMPING SYSTEM

RELATED APPLICATIONS

This application claims the benefit of U.S. Patent Application No. 61/373,071, filed Aug. 12, 2010.

This application is a continuation in part application of U.S. patent application Ser. No. 13/069,244, filed Mar. 22, 2011.

TECHNICAL FIELD

The disclosure herein relates generally to calibration of acoustic systems and, more particularly, to a clamp system for clamping a headset device into a mount used for calibration of the headset acoustic components.

BACKGROUND

Many, if not all, wireless devices that employ one or more microphones require calibration of the microphones to each other or a given standard in order to maximize performance. Many calibration techniques require the microphones of the devices to be accurately placed for calibration. Consequently, there is a need for an accurate and reliable method of clamping a headset into a headset mount.

INCORPORATION BY REFERENCE

Each patent, patent application, and/or publication mentioned in this specification is herein incorporated by reference in its entirety to the same extent as if each individual patent, patent application, and/or publication was specifically and individually indicated to be incorporated by reference.

BRIEF DESCRIPTION OF THE DRAWINGS

FIG. 29 is a table of lengths of different sections for various combinations of straight pipes tested, the total length, and the microphone sampling point, under an embodiment.

INTRODUCTION

Depending on the calibration system used with a headset, relatively small changes in position of the headset in the headset mount can result in variations of approximately +−0.5 dB in the calibration results. More significantly, if the headset is not seated correctly in the headset mount, errors of approximately +−3 dB have been observed. A method and apparatus is described herein for clamping the headset in a headset mount of a calibration system, and uses a clamp system that includes a clamp, platform, and one or more spindles (e.g., cushion spindles) to minimize or eliminate issues associated with positioning of headsets.

In the following description, numerous specific details are introduced to provide a thorough understanding of, and enabling description for, embodiments of the clamp system and calibration system. One skilled in the relevant art, however, will recognize that these embodiments can be practiced without one or more of the specific details, or with other components, systems, etc. In other instances, well-known structures or operations are not shown, or are not described in detail, to avoid obscuring aspects of the disclosed embodiments.

Figure 1:
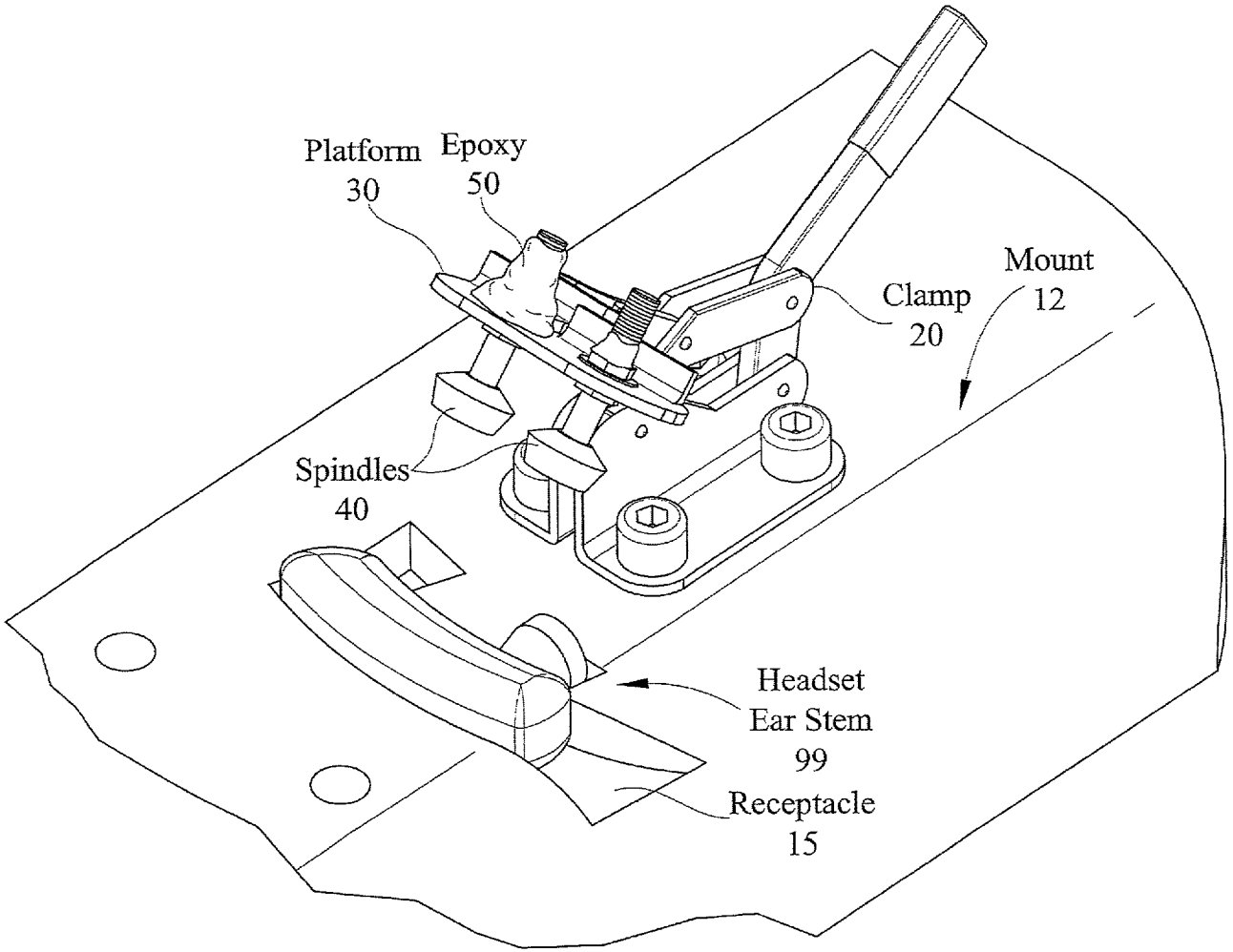
FIG. 1 shows a clamp system, under an embodiment.

FIG. 1 shows a clamp system, under an embodiment. The clamp system 10 of an embodiment comprises a mount 12 having a receptacle 14. When a device 99 is introduced to the mount 12 the receptacle 14 receives at least a portion of a device 99. The clamp system 10 also includes a clamp 20 attached to the mount 12 and comprising a first arm 22 rotateably coupled to a second arm 24 that controls the first arm 22 between an open position and a closed position. A platform 30 and a spindle 40 are connected to the first arm 22. The spindle 40 includes a cushion tip 42 on a distal end, but is not so limited. The example clamp system 10 includes two spindles, but alternative embodiments can include a single spindle or any other number of spindles. When the device 99 is present in the receptacle and the first arm 22 is in the closed position the spindle 40 contacts the device 99 and seats or secures the device 99 in the receptacle 14.

Figure 2:
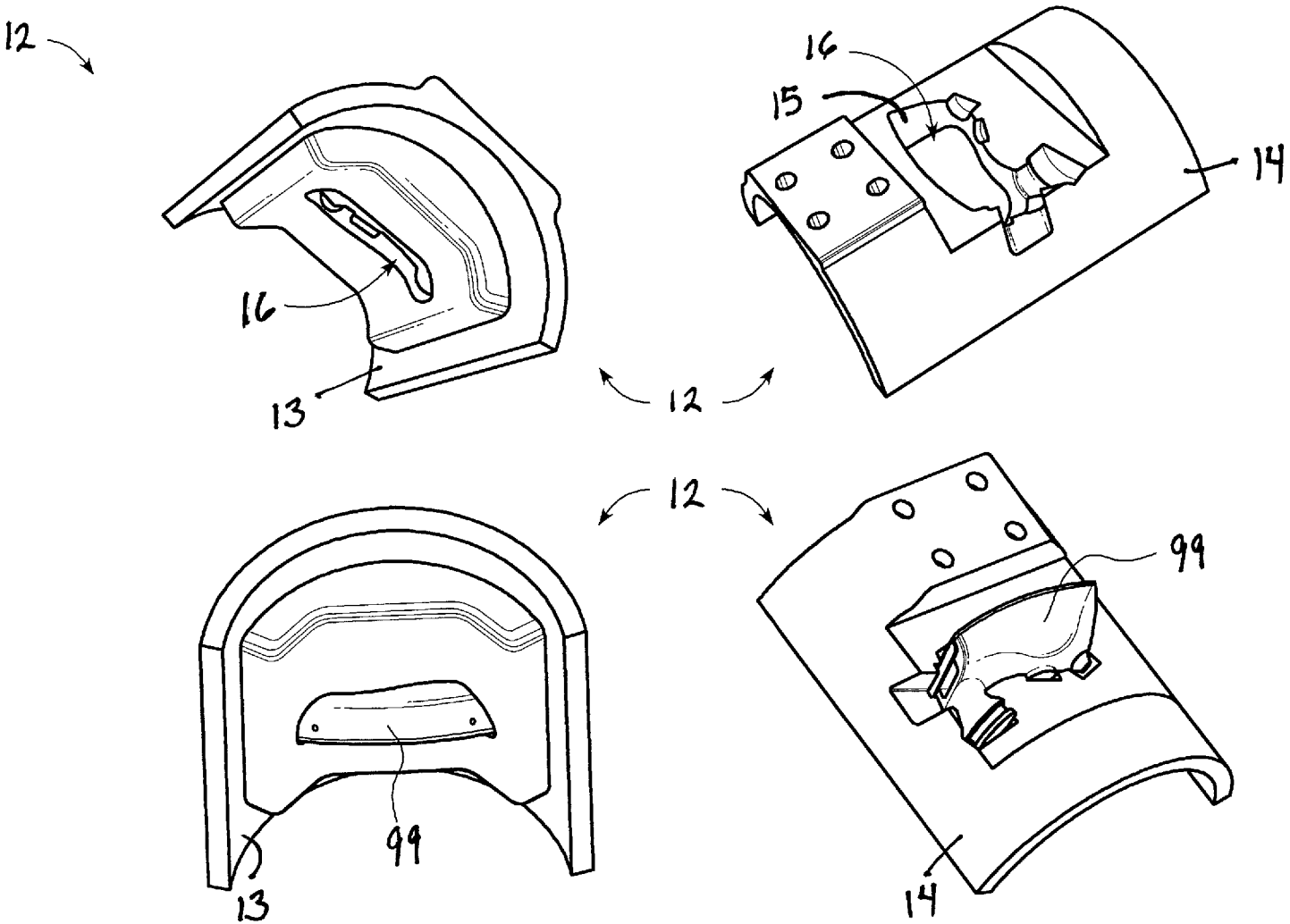
FIG. 2 shows different views of the headset mount used with and without a device (e.g., headset) in place, under an embodiment.

FIG. 2 shows different views of the headset mount 12 shown with and without a device 99 (e.g., headset) in place, under an embodiment. Generally, the mount 12 comprises a curved surface 12 defining an inner region 13 and an outer region 14, so that when the mount 12 is connected to a calibration pipe having a cylindrical cross-section a curvature of the curved surface 12 mates with the calibration pipe and the inner region 13 corresponds to an inner environment of the calibration pipe. The mount 12 includes a receptacle 15 in a shape of at least a portion of the device 99. The receptacle 15 includes an orifice or hole 16 in the mount (pipe) wall just large enough so that the device 99 fits precisely into the orifice 16, such that a first portion of the device 99 is exposed to a first region adjacent to a first side of the mount and a second portion of the device is exposed to a second region adjacent to a second side of the mount.

When the headset 99 is placed in the receptacle 15 and the first arm 22 of the clamp 20 is in the closed position, an attached position at which the clamp 20 is attached to the mount 12 results in the cushion tip of the spindles 40 pulling the device 99 back toward a base of the clamp 20 and securing the device 99 in the receptacle 15. Furthermore, when held securely in place using the clamp 20 (described in detail below), at least a portion of the device 99 is positioned in the inner environment of the calibration pipe a first distance from the curved surface.

As one example of a device 99 calibrated with the use of the clamp system 10, testing was done using the Aliph Jawbone Icon headset, available from Aliph, Inc., San Francisco, Calif.; however, the mount 12 can be configured for use with any device needing calibration. The Jawbone Icon includes two omnidirectional microphones situated approximately 25 millimeters (mm) apart and calibration is performed for operation. The mount 12 of an embodiment positions and holds the Jawbone Icon so that each microphone is at the same relative distance from the calibration pipe wall and the same distance from the loudspeaker (e.g., the two microphones of the headset are approximately 5 mm inside the inside surface of the pipe and an equal distance from the loudspeaker end of the pipe), as described in detail below.

The mount 12 of an embodiment comprises a pipe section having a length and a cylindrical cross-section with an inside diameter. When the device 99 is secured in the receptacle 15 at least a portion of the device 99 is positioned some distance inside the pipe section so that at least a portion of the device 99 is positioned in the inner environment of the calibration pipe a first distance from the curved surface. As an example, the inside diameter of the pipe is approximately in a range of two (2) inches to four (4) inches, and the first distance is approximately in a range of two (2) millimeters to five (5) millimeters.

Figure 3:
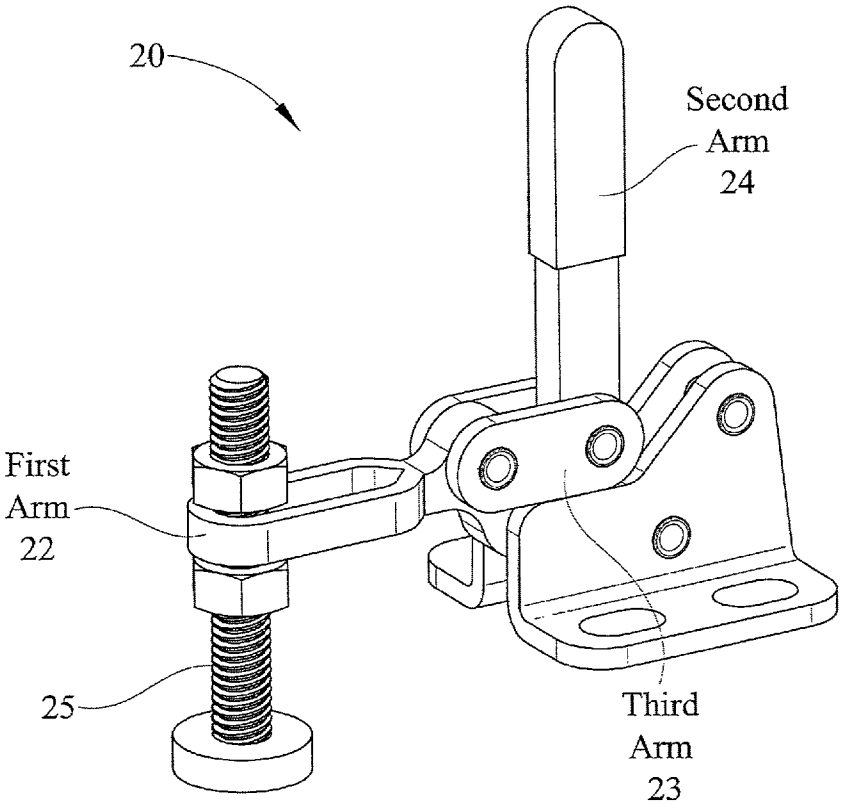
FIG. 3 shows the clamp, under an embodiment.

FIG. 3 shows the clamp 20, under an embodiment. The clamp 20, also referred to herein as the toggle clamp 20, includes a first or load arm 22 rotateably coupled to a second or lever arm 24 that controls the first arm 20 between an open position and a closed position. A third arm 23 rotateably connects to the first arm 22 and to the second arm 24 such that movement of the second arm 24 is translated via the third arm 23 to control the first arm 22 between the open position and the closed position. The clamp 20 is shown in the closed or locked position, and when the second arm 24 is pulled back, the first arm 22 rises into the open position. The clamp 20 is also shown with the default mounting bolt 25, which is discarded and replaced with the spindle 40 and platform described in detail herein. The clamp 20 is coupled or attached to the mount using four M4 hex screws, flat washers, and lock washers, but is not so limited. When the clamp system 10 is used to secure a headset device 99, the configuration of an embodiment moves the headset mount holes from the "top" of the headset (as shown) to the "bottom" of the headset (on the ear-stem side), thereby allowing the clamp 20 to pull the headset 99 down into the headset mount cavity 15, resulting in a consistent fit.

The clamp system 10 of an embodiment includes a platform 30, also referred to as a clamp platform 30, as described above. The clamp platform 30 of an embodiment secures the spindles 40 and couples or connects to the clamp 20. Only one spindle 40 is used in an embodiment, but two spindles 40 ensure that the headset 99 is properly seated in the headset mount 12. Alternative embodiments can have more than two spindles.

Figure 4:
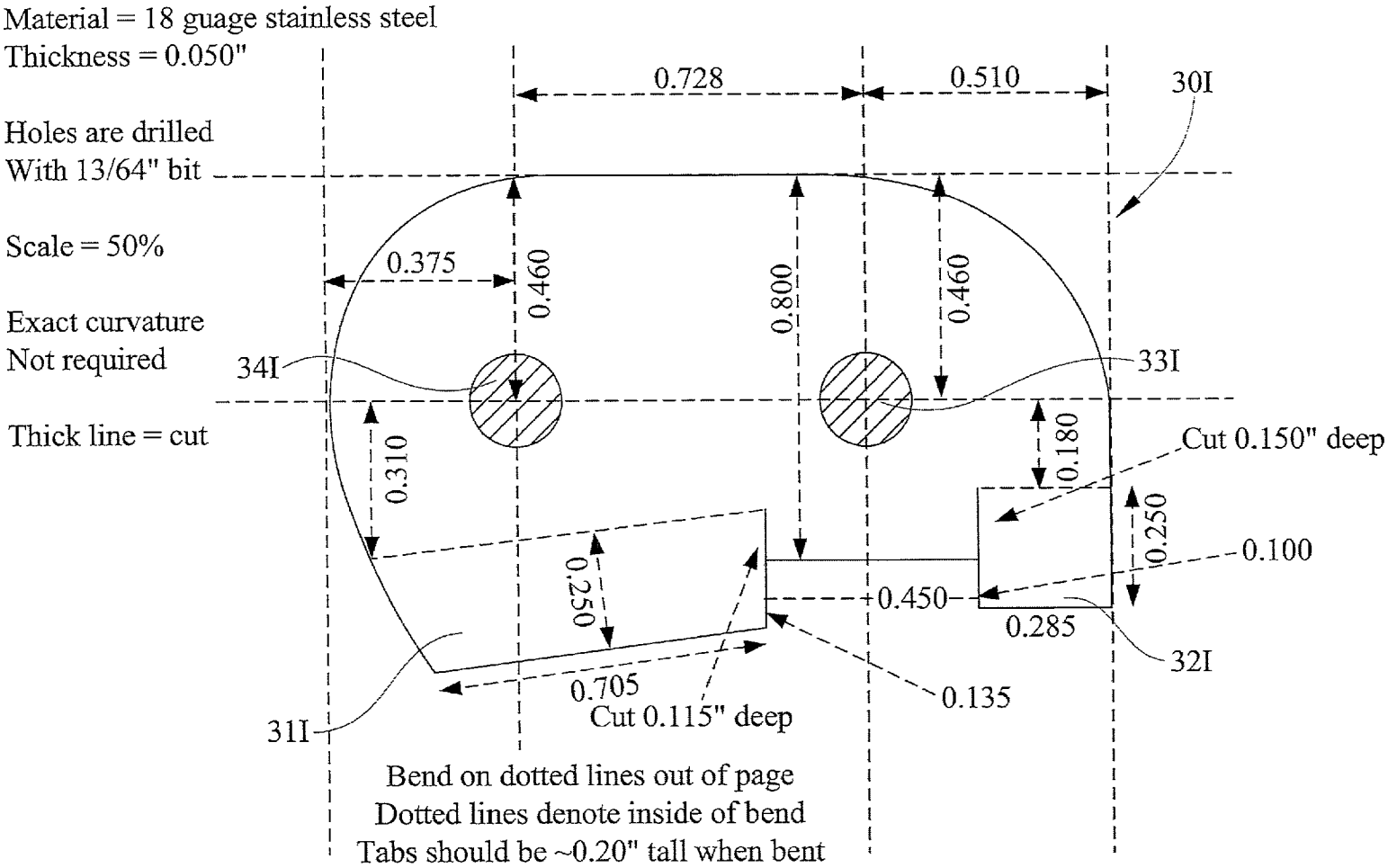
FIG. 4 is a schematic of a platform for a device that is the Jawbone Icon headset, under an embodiment.

FIG. 4 is a schematic of a platform 30I for a device 99 that is the Jawbone Icon headset, under an embodiment. The platform 30I of an embodiment comprises 18-gauge stainless steel, but is not so limited. The platform 30I includes one or more tabs that are folded along the dotted lines (so that a surface of the tab(s) is approximately perpendicular to the surface of the platform 30I) to reduce the chance of the platform 30I rotating on the first arm 22 of the clamp 20 and to give the epoxy or other similar agent structure to adhere to for final assembly. For example, the platform 30I comprises at least one tab 31I or 32I that contacts at least one side of the first arm 22 to secure a position of the platform 30I relative to the first arm 22. The tabs of another embodiment include a first tab 31I, wherein the first tab 31I contacts a first side of the first arm 22 of the clamp 20, and a second tab 32I that contacts a second side of the first arm 22. The tabs 31I and/or 32I are formed from a portion of the platform 30I but are not so limited. An alternative embodiment includes a tab (not shown) on the top of the platform to further increase the stiffness of the steel; however, the stiffness of the 18 gauge steel of an embodiment is sufficient such that the tab is not required.

The platform 30I of an embodiment comprises a first orifice 33I that accepts a first spindle. The spindle is secured to the platform 30I and to the first arm 22 of the clamp 20. In an embodiment the first spindle connects the platform 30I to the first arm 22 of the clamp 20 but is not so limited. When the clamp system 10 includes two spindles 40, the platform 30I comprises a second orifice 34I that is positioned a second distance from the first orifice 33I, and the second orifice 34I accepts the second spindle. The second spindle includes a second cushion tip on a distal end, but is not so limited.

The clamp 20 of an embodiment is reconfigured when a new headset having a different size or microphone location is introduced. The commonalities of the configurations of an embodiment are the use of a toggle clamp, spindles (with or without cushion tips) or similar devices to hold the headset into place, and a platform to hold the spindles. A platform is not always used if only one spindle is used, but two or more spindles ensure a consistent fit.

Figure 5:
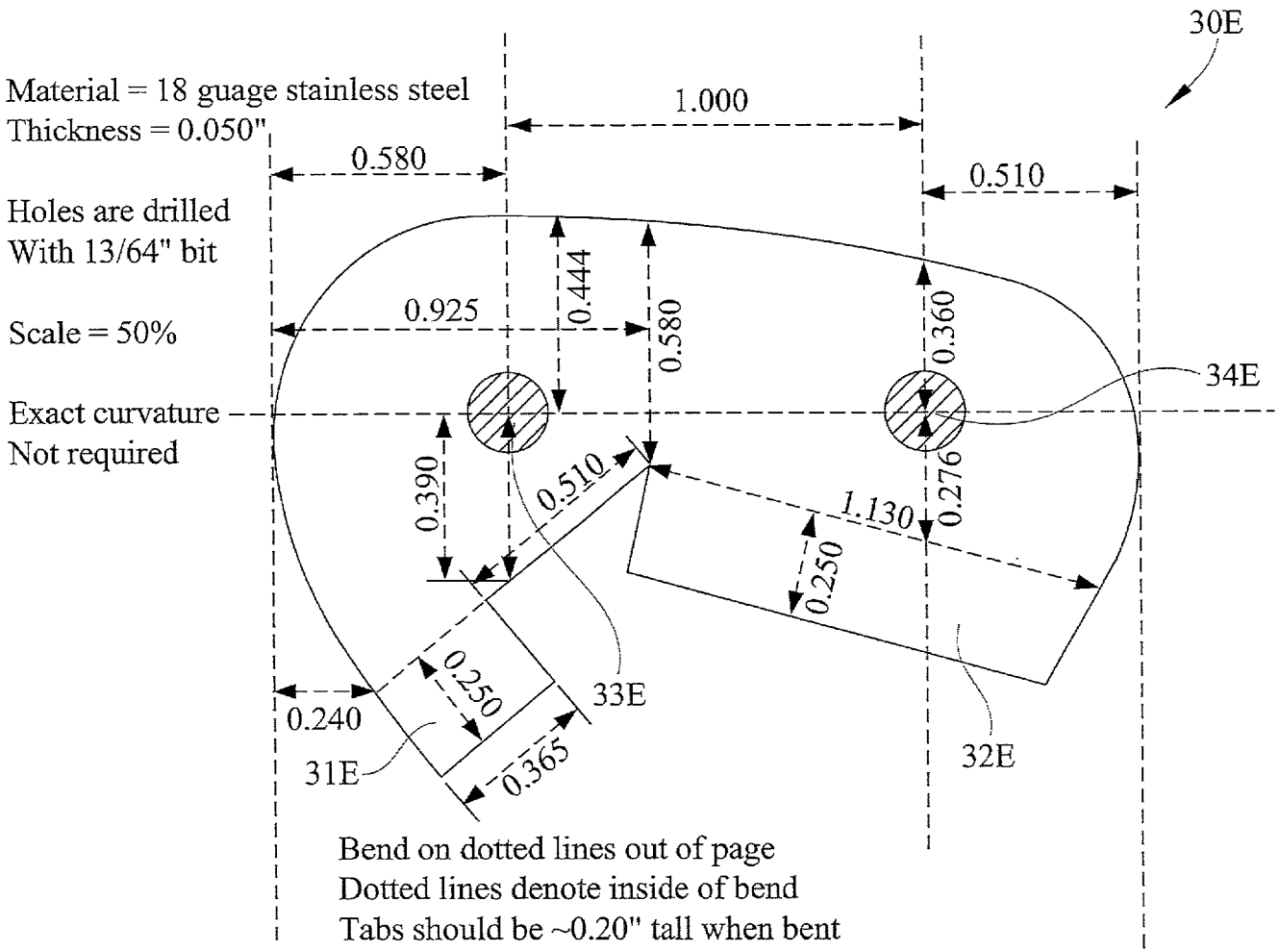
FIG. 5 is a schematic of a platform for a device that is the Jawbone Era headset, under an alternative embodiment.

FIG. 5 is a schematic of a platform 30E for a device 99 that is the Jawbone Era headset, under an alternative embodiment. The features of this alternative platform 30E are as described above, with the exception that some features are positioned differently on the platform as a result of the difference in size and microphone locations for the alternative headset.

The platform 30E of an embodiment comprises 18-gauge stainless steel, but is not so limited. The platform 30E includes one or more tabs that are folded along the dotted lines (so that a surface of the tab(s) is approximately perpendicular to the surface of the platform 30E) to reduce the chance of the platform 30E rotating on the first arm 22 of the clamp 20 and to give the epoxy or other similar agent structure to adhere to for final assembly. For example, the platform 30E comprises at least one tab 31E or 32E that contacts at least one side of the first arm 22 to secure a position of the platform 30E relative to the first arm 22. The tabs of another embodiment include a first tab 31E, wherein the first tab 31E contacts a first side of the first arm 22 of the clamp 20, and a second tab 32E that contacts a second side of the first arm 22. The tabs 31E and/or 32E are formed from a portion of the platform 30E but are not so limited. An alternative embodiment includes a tab (not shown) on the top of the platform to further increase the stiffness of the steel; however, the stiffness of the 18 gauge steel of an embodiment is sufficient such that the tab is not required.

The platform 30E of an embodiment comprises a first orifice 33E that accepts a first spindle. The spindle is secured to the platform 30E and to the first arm 22 of the clamp 20. In an embodiment the first spindle connects the platform 30E to the first arm 22 of the clamp 20 but is not so limited. When the clamp system 10 includes two spindles 40, the platform 30E comprises a second orifice 34E that is positioned a second distance from the first orifice 33E, and the second orifice 34E accepts the second spindle. The second spindle includes a second cushion tip on a distal end, but is not so limited.

The clamp 20 of an embodiment is reconfigured when a new headset having a different size or microphone location is introduced. The commonalities of the configurations of an embodiment are the use of a toggle clamp, spindles (with or without cushion tips) or similar devices to hold the headset into place, and a platform to hold the spindles. A platform is not always used if only one spindle is used, but two or more spindles ensure a consistent fit.

Figure 6:
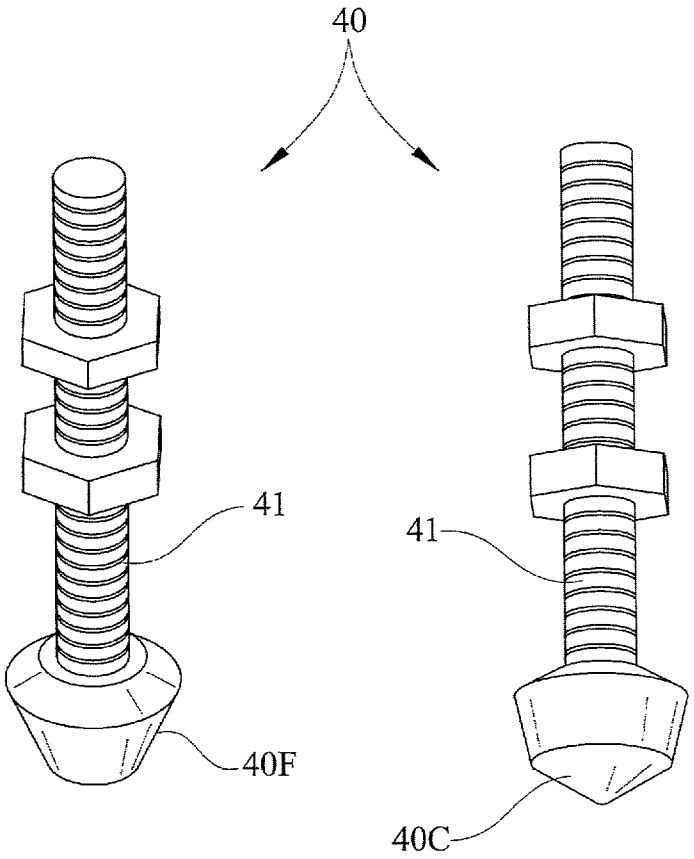
FIG. 6 shows a spindle with a flat (left) cushion tip and a spindle with a conical (right) cushion tip, under an embodiment.

FIG. 6 shows a spindle 40 with a flat 40F (left) cushion tip and a spindle with a conical 40C (right) cushion tip, under an embodiment. The spindles 40 of an embodiment include threaded bolts 41 with tips 40F/40C formed from a cushioning or pliable material, and the tips can be reshaped using knives, files or similar tools to better fit the headset surface. The spindles 40 are bolted onto the platform 30 using flat and lock washers and held in place using epoxy 50 (optionally) to prevent misalignment.

The components of the clamp system 10 described above are assembled together using standard hardware (e.g., flat washers, lock washers, nuts, etc.) and are then adjusted or aligned using a headset mount and test headsets. When aligned, epoxy 50 (optional) can be applied to the components to ensure that the positions of the spindles relative to the headset do not change during use.

FIGS. 7-10 show different views of a clamp system 10 for use with a device 99 that is the Jawbone Icon headset, under an embodiment. The embodiments shown include two spindles 40, each with flat cushion tips 40F. One spindle 40M contacts the device 99 near the middle of the headset and one spindle 40E contacts the device 99 near the ear stem. The spindle 40E contacting the device 99 nearest the ear stem helps ensure that the headset 99 is properly seated in the mount. The epoxy 50 holds all the pieces in place and the bent tabs 31I/32I add strength to the platform and allow the epoxy 50 to hold onto the platform 30I more effectively.

Figure 7:
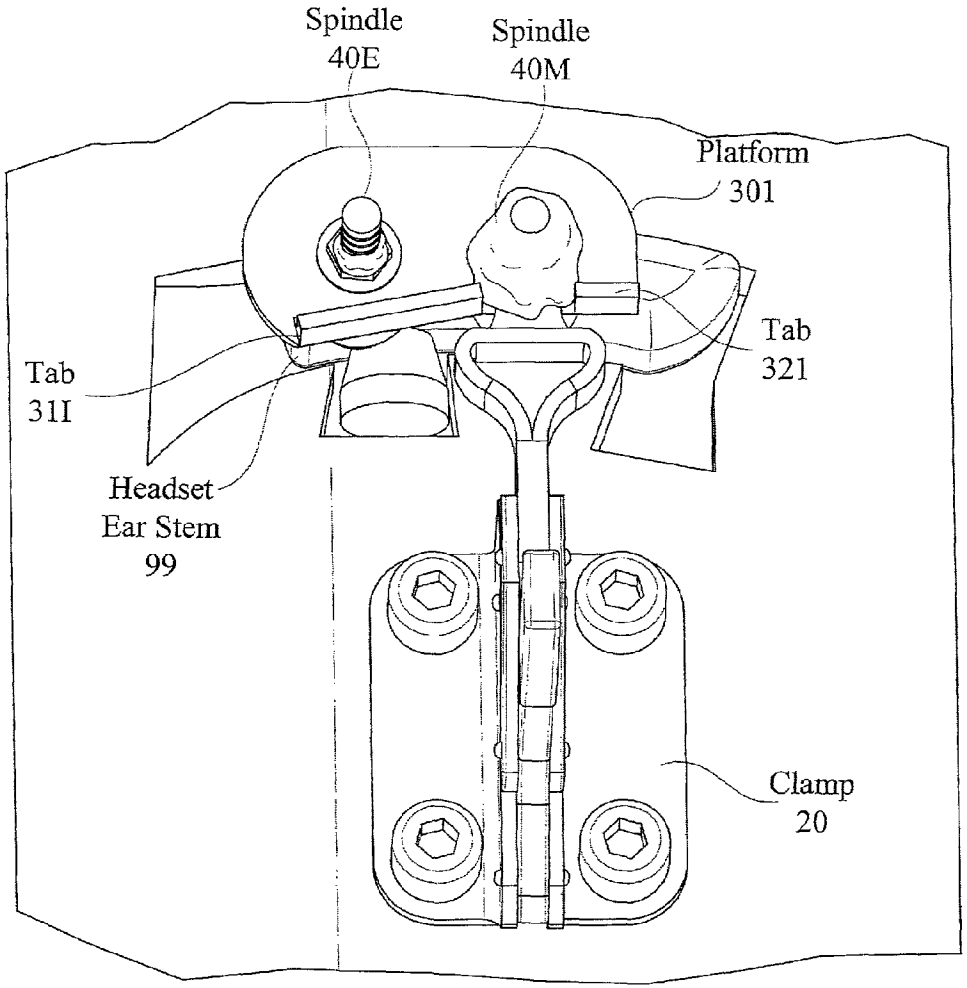
FIG. 7 shows a top view of the clamp system, under an embodiment.

FIG. 7 shows a top view of the clamp system 10, under an embodiment. The spindle locations of this embodiment include a first spindle 40M contacting the middle of the device 99 and a second spindle 40E contacting the device 99 near the ear stem. Epoxy 50 is used to hold the components of the clamp system 10 in proper alignment. The tabs 31I/32I add strength to the platform 30I and allow the epoxy 50 to hold onto the platform 30I more effectively.

Figure 8:
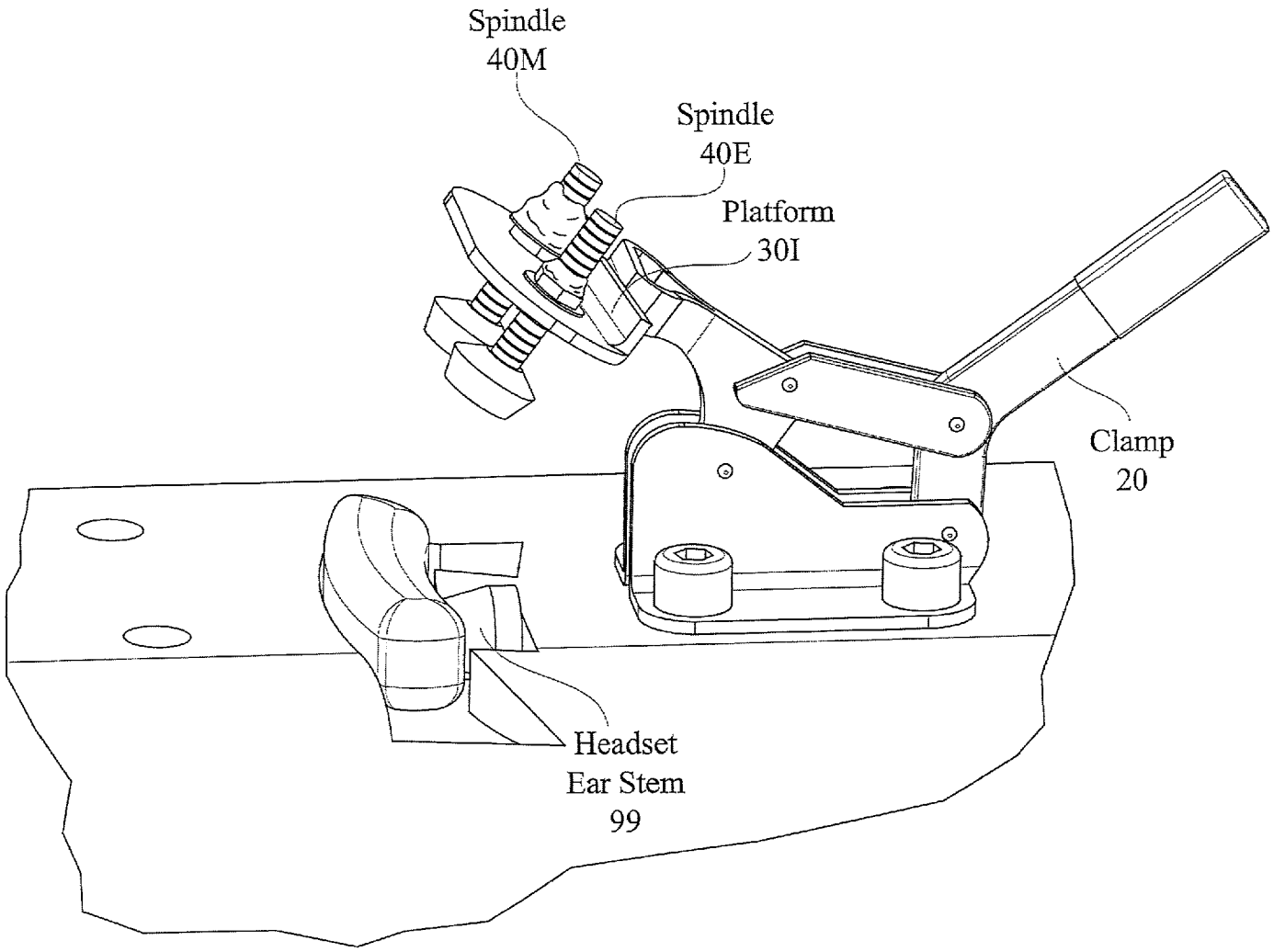
FIG. 8 shows a side view of the clamp system with the clamp in the open position, under an embodiment.
Figure 9:
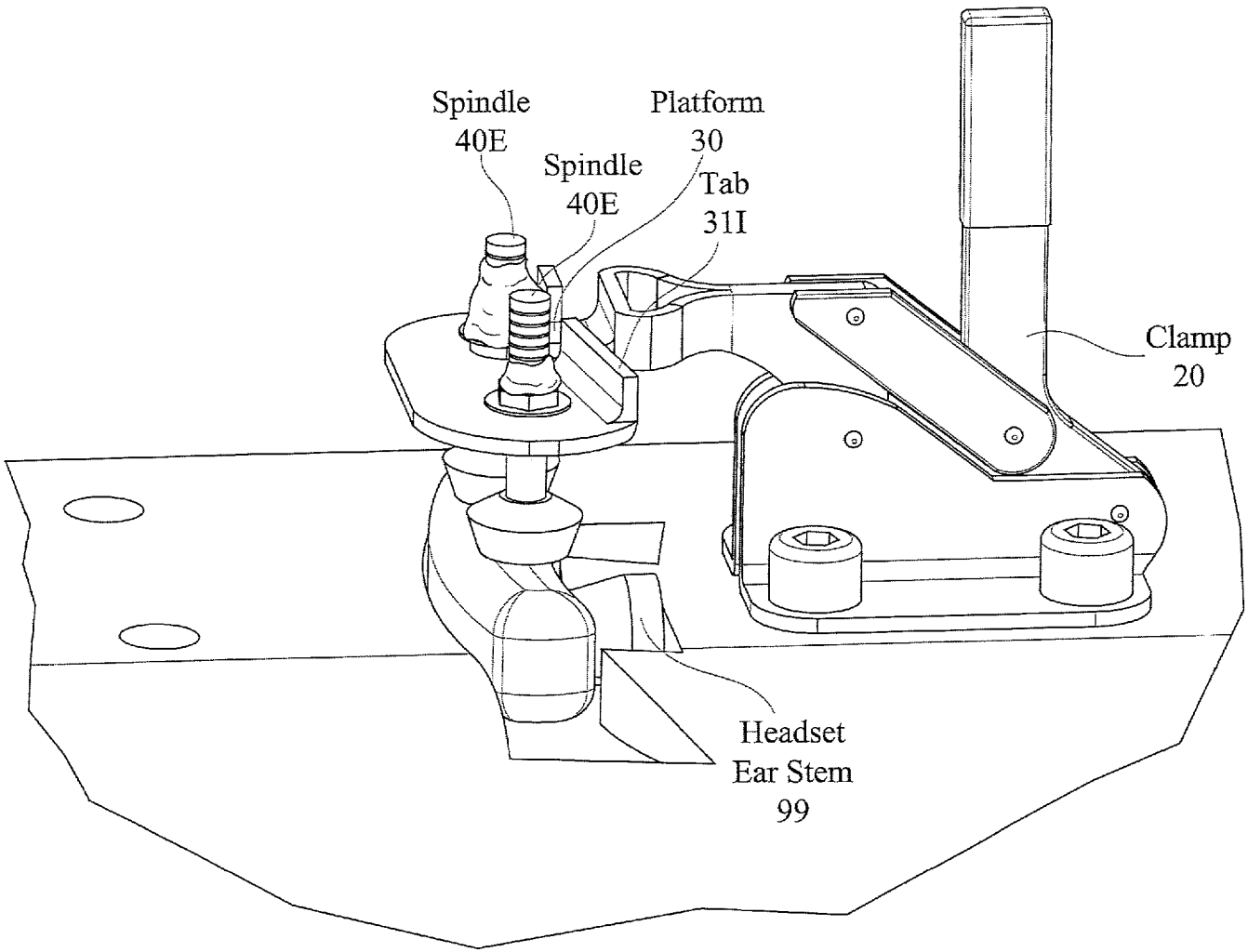
FIG. 9 shows a side view of the clamp system with the clamp in the closed and locked position, under an embodiment.
Figure 10:
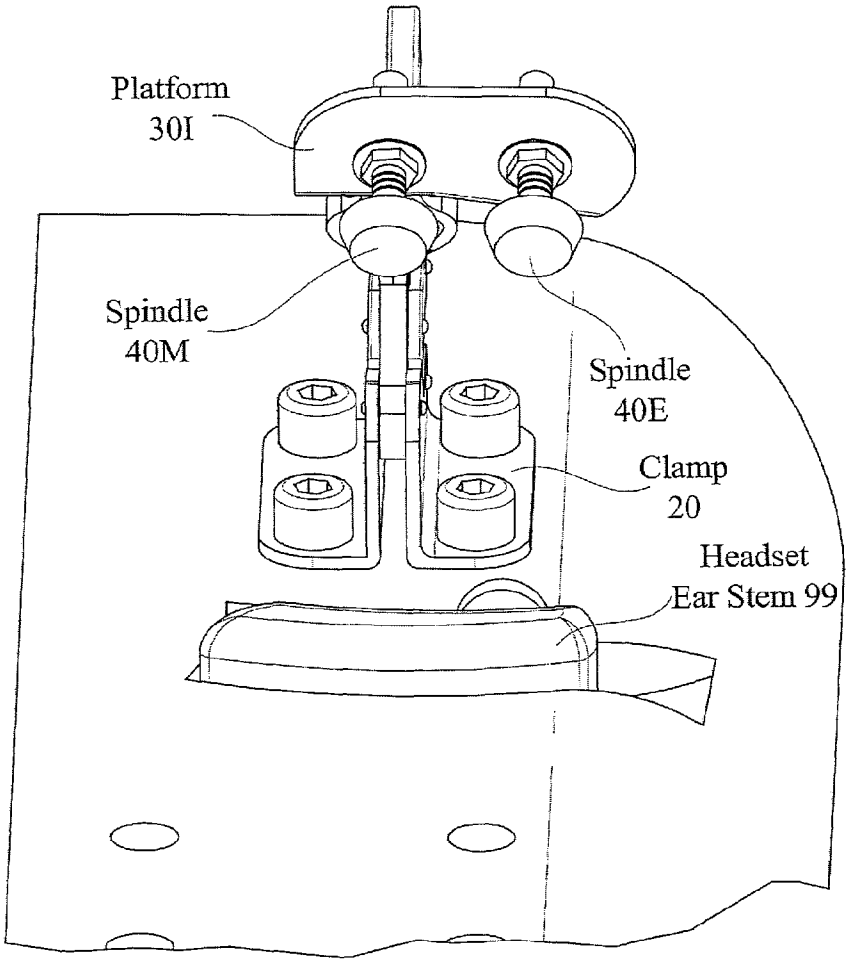
FIG. 10 shows a front view of the clamp system with the clamp in the open position, under an embodiment.

FIG. 8 shows a side view of the clamp system 10 with the clamp in the open position, under an embodiment. FIG. 9 shows a side view of the clamp system 10 with the clamp in the closed and locked position, under an embodiment. FIG. 10 shows a front view of the clamp system 10 with the clamp in the open position, under an embodiment.

FIGS. 11-15 show different views of a clamp system 10 with an alternative platform 30E for use with a device 99 that is the Jawbone Era headset, under an embodiment. For the Jawbone Era headset, the microphones are on the opposite side from the Jawbone Icon headset, so the headset ear stem is on the right side of the clamp system 10 compared to the left side for the Jawbone Icon headset. The embodiments shown include one spindle 40M with a flat cushion tip ("flat spindle") and one spindle 40E with a conical cushion tip ("conical spindle"). The flat spindle 40M contacts the device 99 near the middle of the headset and more securely pushes the headset back into the receptacle. The conical spindle 40E, which fits into the valley in the ear stem, contacts the device 99 near the ear stem and, as such, ensures that the headset 99 is properly seated in the mount. The epoxy 50 holds all the pieces in place and the bent tabs 31E/32E add strength to the platform and allow the epoxy 50 to hold onto the platform 30E more effectively.

Figure 11:
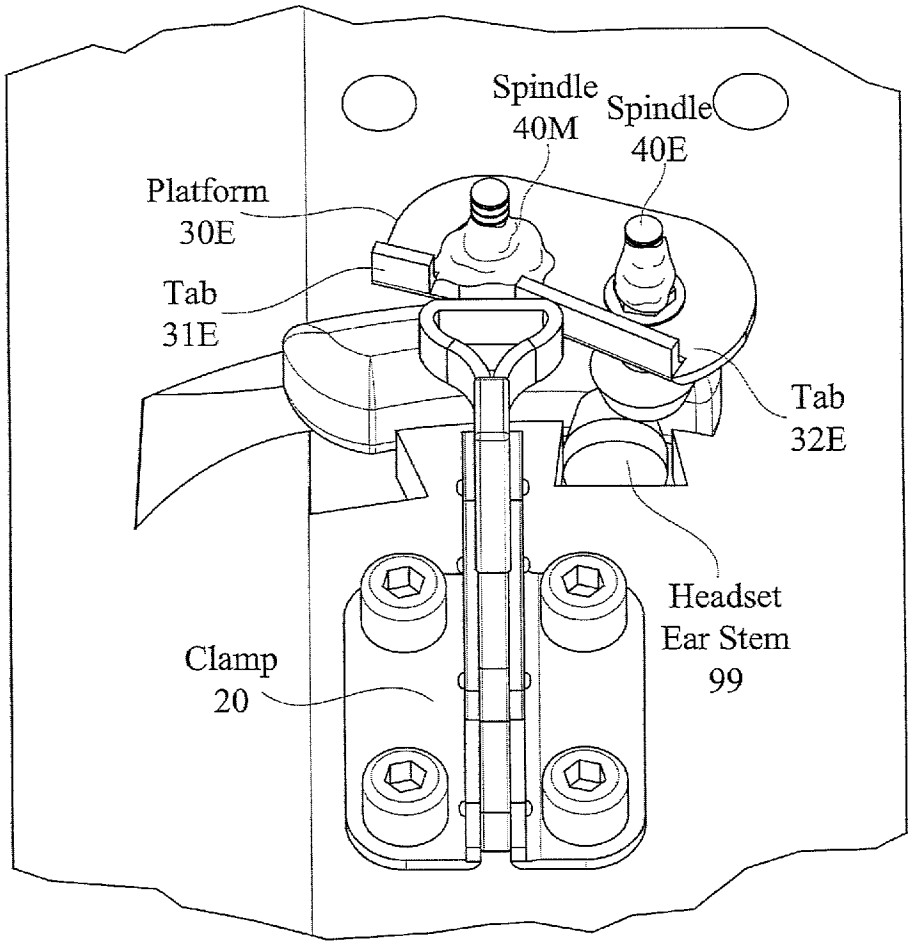
FIG. 11 shows a top view of the clamp system, under an embodiment.

FIG. 11 shows a top view of the clamp system 10, under an embodiment. The spindle locations of this embodiment include a first spindle 40M contacting the middle of the device and a second spindle 40E contacting the device near the ear stem. Epoxy 50 is used to hold the components of the clamp system 10 in proper alignment. The tabs 31E/32E add strength to the platform 30E and allow the epoxy 50 to hold onto the platform 30E more effectively.

Figure 12:
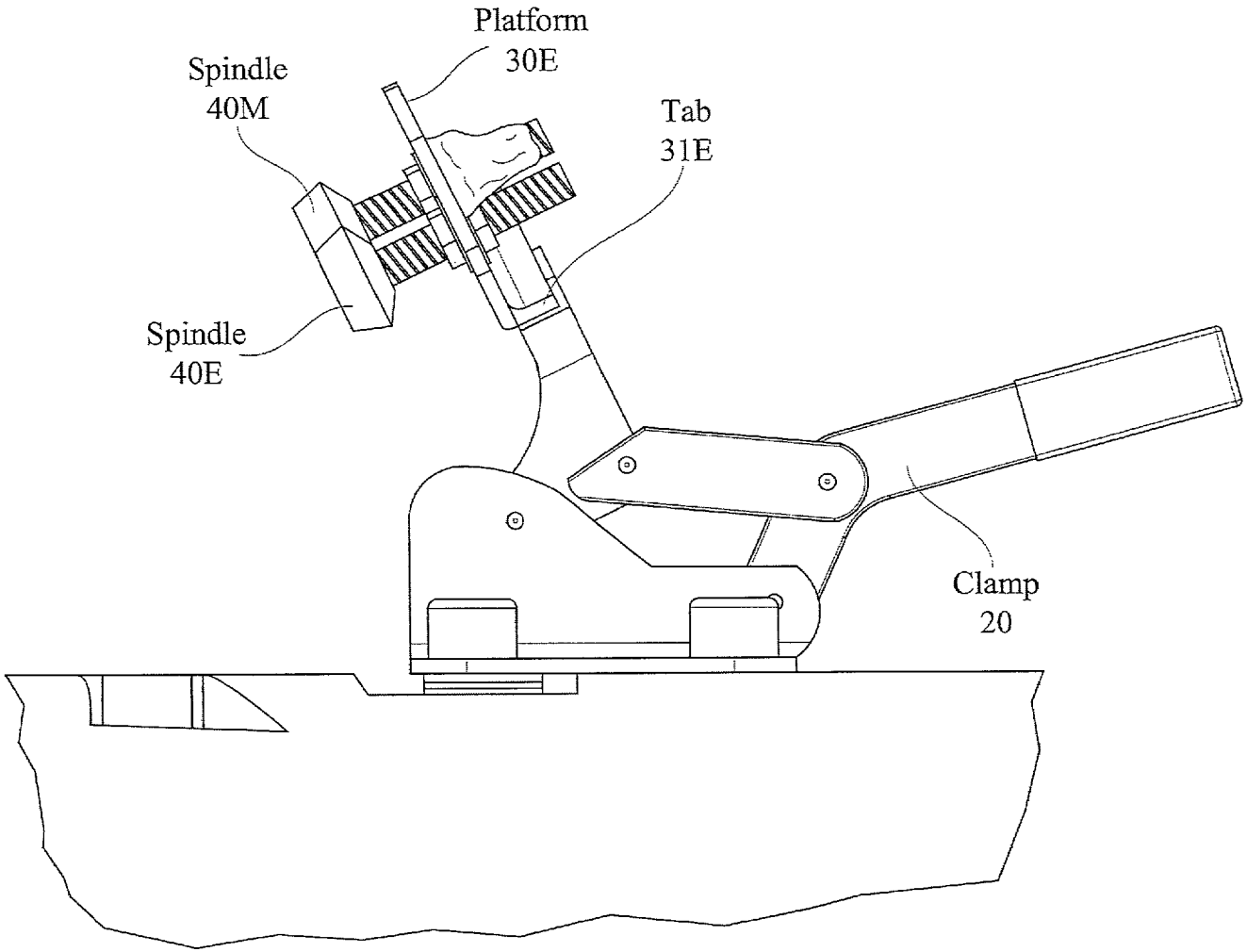
FIG. 12 shows a side view of the clamp system with the clamp in the open position, under an embodiment.
Figure 13:
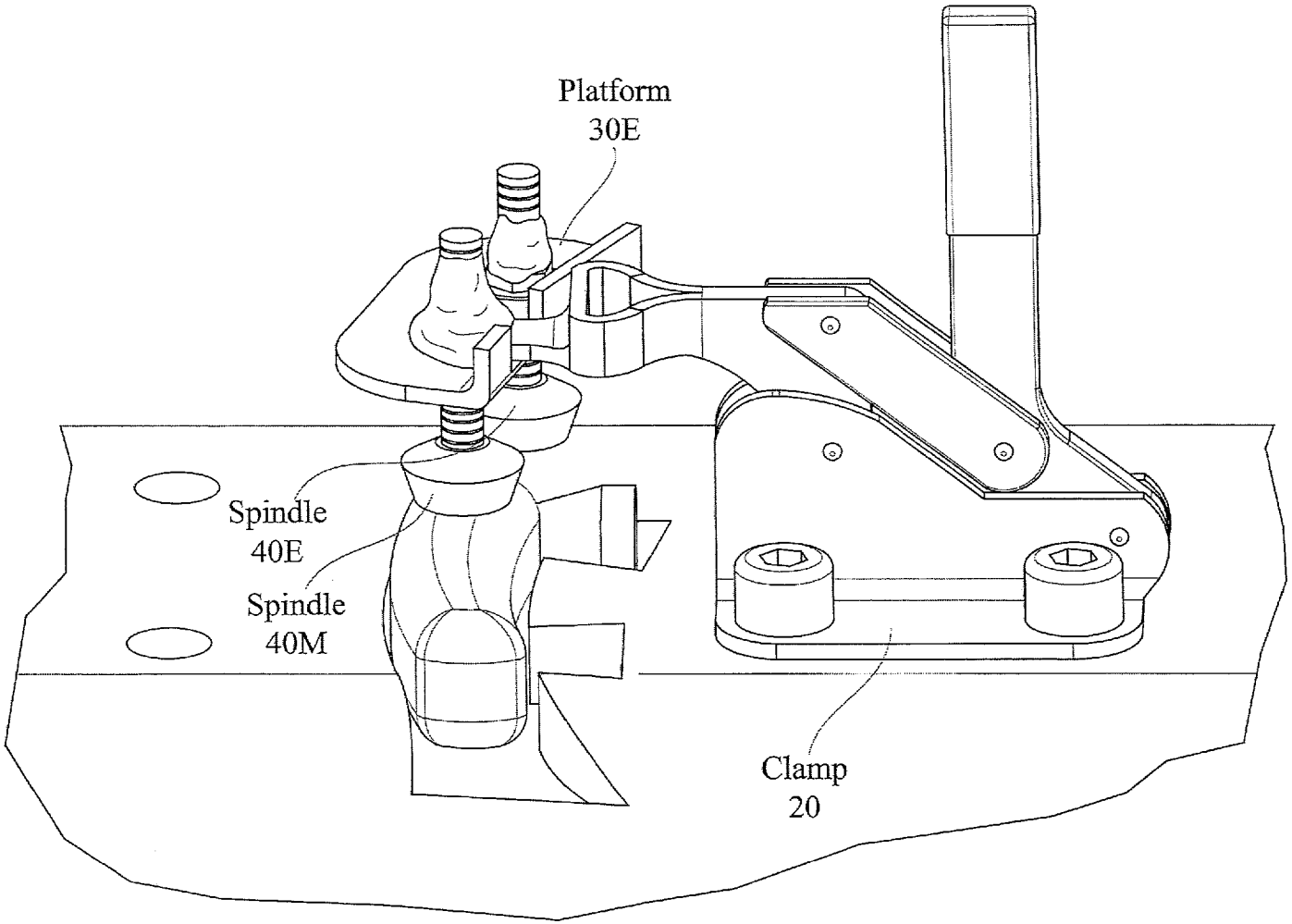
FIG. 13 shows a side view of the clamp system with the clamp in the closed and locked position, under an embodiment.
Figure 14:
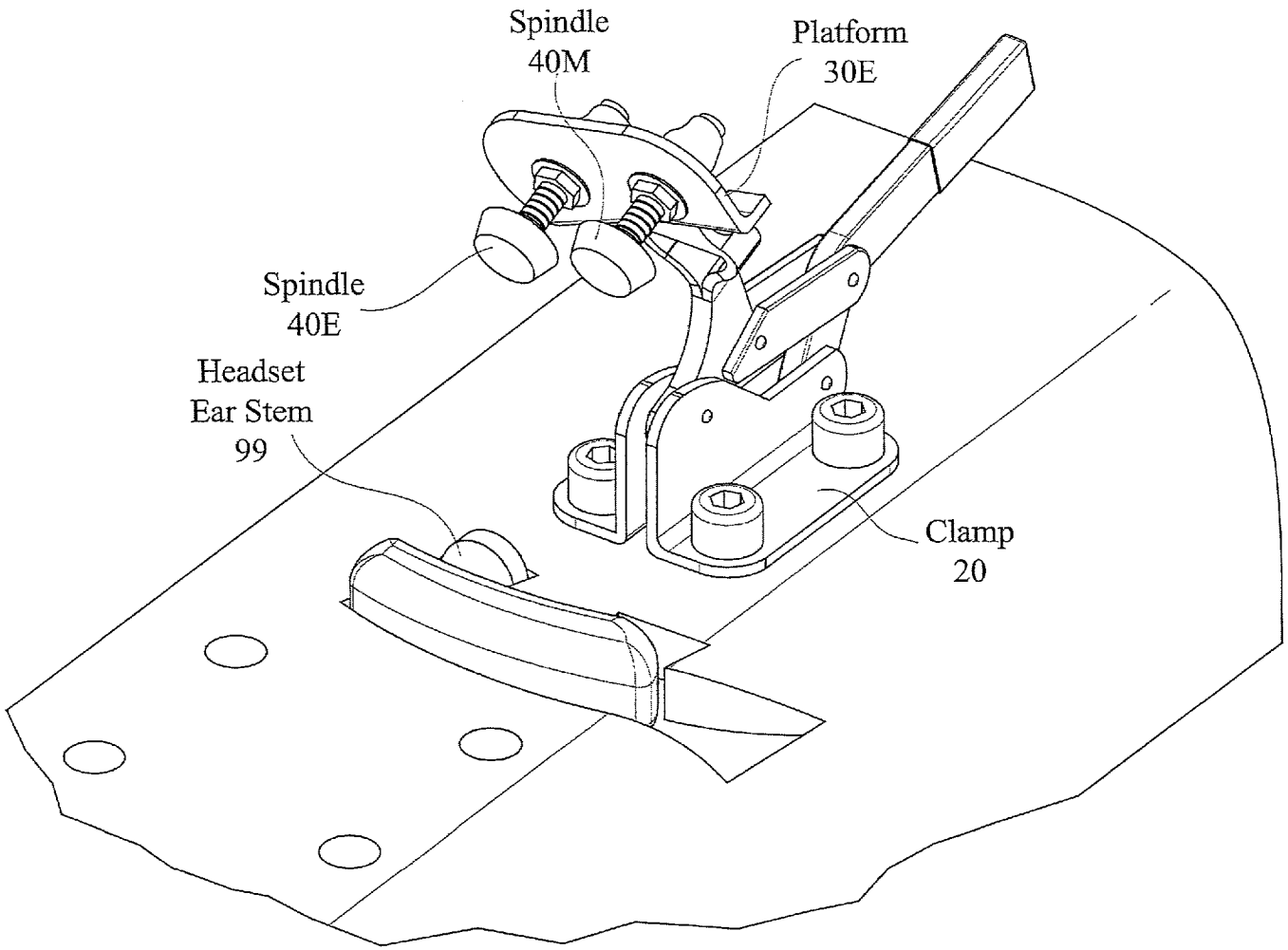
FIG. 14 shows a front perspective view of the clamp system with the clamp in the open position, under an embodiment.
Figure 15:
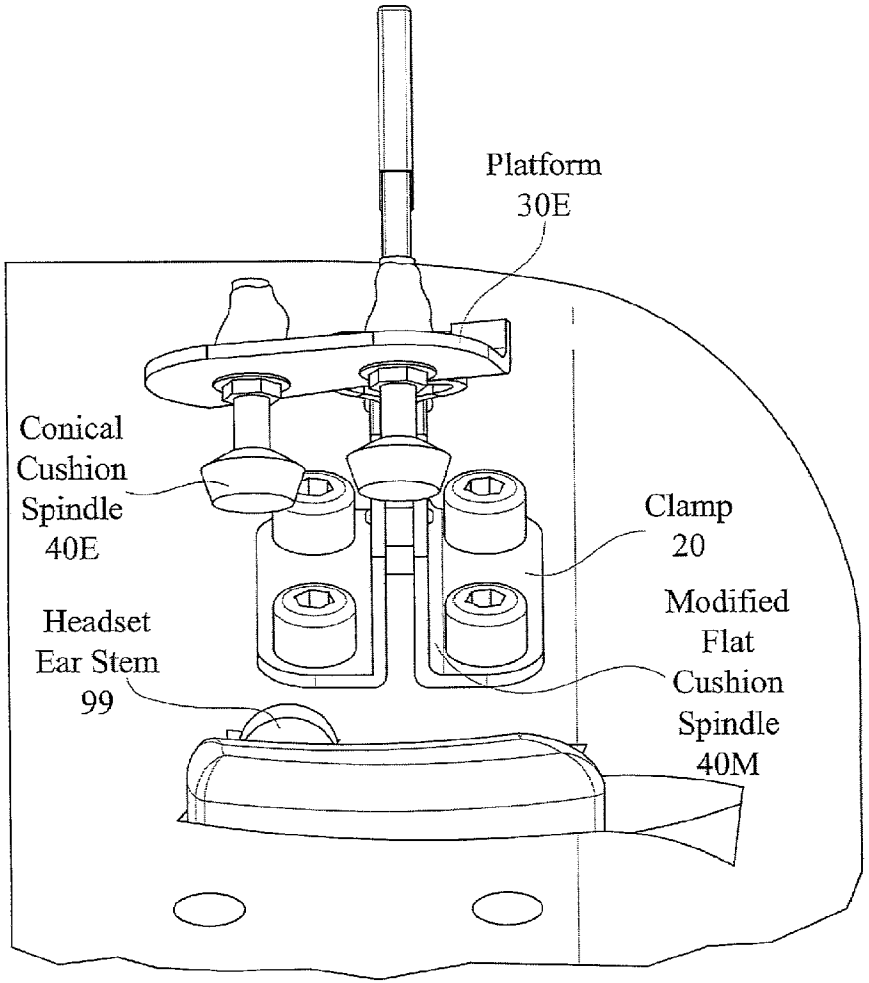
FIG. 15 shows a front view of the clamp system with the clamp in the open position, under an embodiment.

FIG. 12 shows a side view of the clamp system 10 with the clamp in the open position, under an embodiment. FIG. 13 shows a side view of the clamp system 10 with the clamp in the closed and locked position, under an embodiment. FIG. 14 shows a front perspective view of the clamp system 10 with the clamp in the open position, under an embodiment. FIG. 15 shows a front view of the clamp system 10 with the clamp in the open position, under an embodiment.

Figure 16:
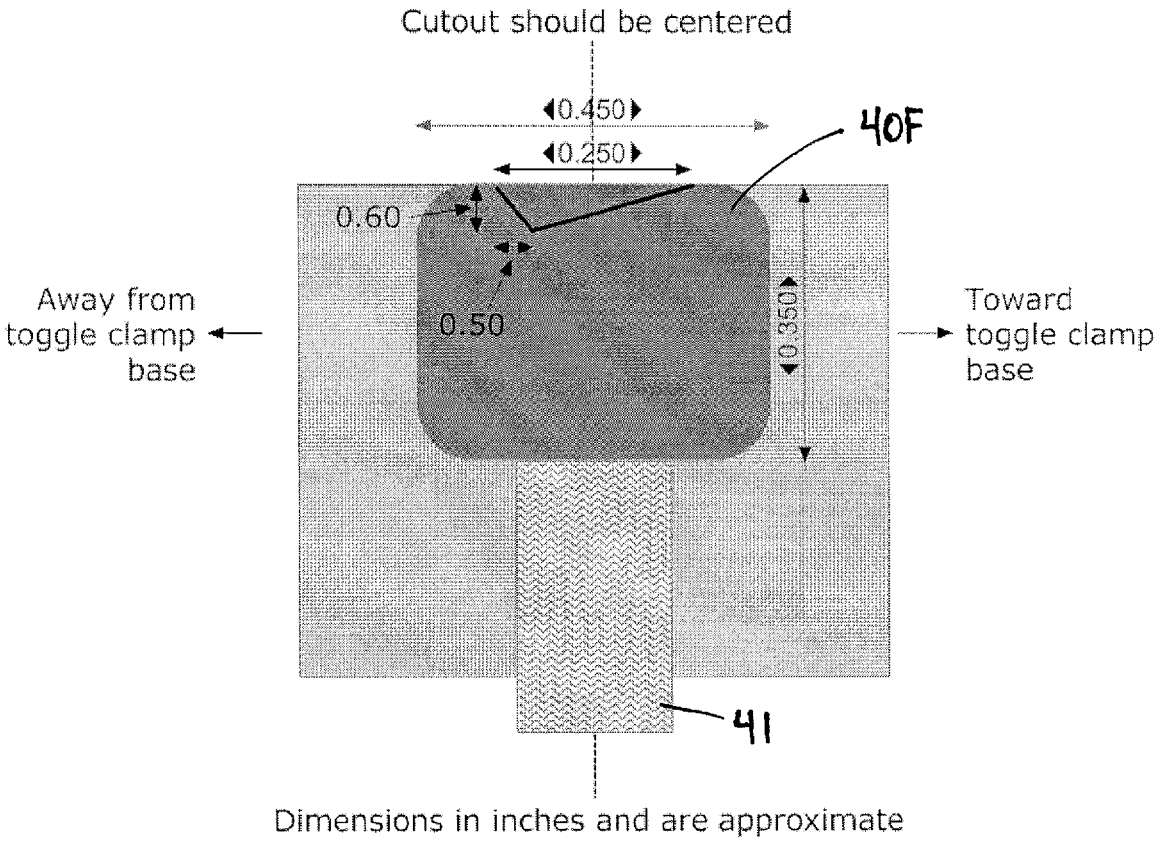
FIG. 16 shows a modification to the flat spindle that includes a notch cut into the spindle, under an embodiment.

The flat spindle 40M which contacts the device near the middle of the headset 99 and more securely pushes the headset 99 back into the receptacle includes a modification that improves seating of the headset 99 in its mount, thereby improving mounting accuracy and reliability. FIG. 16 shows a modification to the flat spindle that includes a notch cut into the flat tip 40F, under an embodiment. The area in the "notch" above the solid black lines is removed, and the flat spindle mounted as shown.

During assembly of the clamp system, the spindles are located horizontally as shown, but vertically they are adjusted so that they touch the headset at the same time or so that the earstem spindle touches slightly (~0.02") before the middle spindle. As the ear stem can sometimes not be seated properly, this earlier touching can sometimes cause the ear stem to slide in and seat properly. The pressure to lock the toggle clamp handle should be enough so that a misplaced ear stem that is not slid into place using the earstem spindle will prevent the system from locking. If the spindles are too high, they will compress enough to allow the toggle clamp to lock even if the earstem is not seated properly. If the spindles are too low, the amount of force required to lock the toggle clamp will be too high and damage to the headset may occur.

The clamp system described above is used to secure a headset in a headset mount of a calibration system. The calibration system is a system used to calibrate microphones of a headset device to a high degree of accuracy in a noise-robust way using cylindrical pipes. In order to properly calibrate the microphones, the calibration system exposes them to identical acoustic inputs at the frequencies of interest. "Identical", in this case, means that the acoustic inputs generally should have the same amplitude and phase for both microphones. Practically, this means variations of less than +−0.1 dB and +−5 degrees between the acoustic inputs. The frequencies of interest will depend on the application—for Bluetooth headsets calibration is normally required up to 4 kHz, but may be 8 kHz or higher for other applications.

Calibration is accomplished with the microphones in the headset or other final mounting configuration so that they are calibrated similar to the manner that they will be used. The calibration system uses cylindrical pipes to contain the output from a loudspeaker and funnel it to the microphones of the headset for calibration. Cylindrical pipes have resonant frequencies that depend on their length and the type of end cap they have, and this can be used to control the acoustic energy experienced by the microphones. Another embodiment uses acoustic energy absorbers to remove reflections inside the pipe, exposing the microphones to a traveling wave of the same amplitude and phase. The microphones can be placed so that they are just inside the surface of the pipe or inside the pipe itself. The embodiments described herein are stable in operation, flexible with respect to microphone mount and location, and have proven to be robust with respect to exterior noise (no additional noise-proofing is required) and calibration algorithms.

Unless otherwise specified, the following terms have the corresponding meanings in addition to any meaning or understanding they may convey to one skilled in the art.

The term "omnidirectional microphone" means a physical microphone that is equally responsive to acoustic waves originating from any direction.

The term "O1" or "$O_1$" refers to the first omnidirectional microphone of an array, normally closer to the user than the second omnidirectional microphone. It may also, according to context, refer to the time-sampled output of the first omnidirectional microphone.

The term "O2" or "$O_2$" refers to the second omnidirectional microphone of an array, normally farther from the user than the first omnidirectional microphone. It may also, according to context, refer to the time-sampled output of the second omnidirectional microphone.

The term "noise" means unwanted environmental acoustic noise.

The term "virtual microphones (VM)" or "virtual directional microphones" means a microphone constructed using two or more omnidirectional microphones and associated signal processing.

The calibration system of an embodiment uses standard cylindrical pipe to form an acoustic cavity. This can be plastic PVC or ABS pipe, or cast iron, or other similar pipe. PVC and ABS pipe are recommended; they are inexpensive, easily cut and shaped, and have functioned well in tests. The pipes can be a single piece or several sections; for ease of construction and transport segmented sections using unions to connect them have been used with success. The pipes should be smooth and fit together tightly, although small gaps between sections have not proven to be a problem. The pipes can be glued together, but it is not necessary—slip fits are sufficient. A machined or otherwise fabricated adapter for the loudspeaker/pipe interface is recommended, but simply taping the loudspeaker to the pipe has resulted in adequate performance for many applications.

Since the amplitude of the wave in the pipe can vary with distance from the center of the pipe, the microphones should be mounted on or in the pipe so that they are the same distance from the center or wall of the pipe. If the resonant pipe is used, the microphones should be placed the same distance from the end of the pipe, since the amplitude and phase will vary with both frequency and distance from the end of the pipe. If the absorbent pipe is used, the microphones need not be the same distance from the end of the pipe, as the traveling wave amplitude should be relatively independent of the distance from the loudspeaker. The calibration routine, however, will have to be adjusted to take into account the time delay between the microphones due to the difference in distance to the loudspeaker. The microphones should be placed a sufficient distance from the loudspeaker to reduce near-field effects of the loudspeaker. In practice this was about 30 cm for the absorbent pipe and 20 cm for the resonant pipe, but this distance will depend on the loudspeaker and the frequencies of interest.

The microphones may be mounted near the inside surface of the pipe or inside the pipe itself. For applications where the highest accuracy is desired and the geometric effect of the microphone housing is not desired or important, it is recommended to mount the microphones so that they are just inside (e.g., approximately 2-5 mm for a 2.0 inch I.D. pipe) the inside surface of the pipe. This type of mount reduces the acoustic effect of the microphone housing on the inside environment of the pipe. For applications where the housing is small and/or the geometric effect of the housing on the response of the microphones is desired, the microphones and their mounting body (i.e., a headset) may be placed inside the pipe itself. This will affect the acoustic properties of the interior of the pipe, so comparison of the results calculated with an in-pipe mount to those calculated in an anechoic chamber is recommended.

For frequencies below 4 kHz, the recommended inside diameter (I.D.) of the pipe is 2.0 inches. This results in excellent stability and adequate amplitude and phase performance from near DC to about 3.8 kHz. A 3.0 inch I.D. pipe may be used, but this reduces the upper adequate performance frequency to about 2.5 kHz. A 4.0 inch I.D. pipe further reduces the upper adequate performance frequency to about 1.9 kHz. The upper adequate performance frequency can be estimated by using $$f_1 = \frac{1.125 * 343 \text{ m/s}}{2d} \text{ Hz}$$

where the speed of sound has been estimated at 343 m/s and "d" is the inside diameter of the pipe in meters. Above this frequency the propagation of the acoustic waves are no longer parallel to the pipe; they begin to reflect from the sides of the pipe and propagate perpendicular to the length of the pipe. This disrupts the amplitude and phase for both kinds of pipes (absorbent and resonant) and results above these frequencies should be disregarded or, at least, confirmed using other means (e.g., using results from an anechoic chamber).

The loudspeaker is mounted to the pipe so that there is little or no leakage between the pipe and the loudspeaker. The other end of the pipe can be capped (closed) or open, depending on the desired response. Closed pipes are recommended for both resonant and absorbent pipes; for the former the resonances continue to much higher frequencies for closed pipes compared to open, and for the latter it results in a cleaner installation. For the absorbent enablement the end cap does not serve an acoustic function since enough absorbent material should be used so that the amount of energy reflecting from the cap or open end should be minimal. This means using enough absorbent material so that the amount of energy returning to the microphones is at least 40 dB less than the directly transmitted energy. More reflected energy can be tolerated, but can result in less robust performance and is not recommended.

The loudspeaker is excited using an electrical signal at a level that results in a good output level of the microphones under test. That is, the microphones should not be overdriven and a level of −12 dBFS is recommended. In addition, it is recommended that the exciting signal be equalized so that it is relatively white at the point it is being sampled by the microphones. With a resonant pipe this is not strictly possible, but the heights of the resonances can be approximately equalized. For an absorbent pipe the whitening equalization is usually relatively simple to do. This is not required but results in better performance and behavior from most calibration filter algorithms.

The output of the microphones is recorded and a conventional calibration processing technique is used to generate a calibration filter or filters, depending on the technique and the number of microphones. Any number of microphones may be calibrated using this embodiment, the only limit is how many of the microphones can be mounted properly on the pipe. The calibration filters generated by the calibration technique are then used to filter the output of each microphone so that the amplitude and phase of the microphones are equal for an identical input. This application does not include the signal processing calibration algorithm that generates the calibration filters using the outputs of the microphones when exposed to the acoustic energy inside the pipe. The novelty of this technique lies in the configuration of the loudspeaker, the pipes, and the microphones so that the acoustic energy each microphone is exposed to is as nearly identical in amplitude and phase as possible. Any suitable calibration algorithm may be used.

For resonant pipe embodiments only straight pipes are recommended. Curves in the pipes can lead to poor resonance characteristics. For absorbent pipe embodiments straight pipes or pipes with curved sections are allowed. The curved sections, though, should only be used after a significant amount of absorption has taken place. Pipes with curved sections are useful where space is limited.

Figure 17:
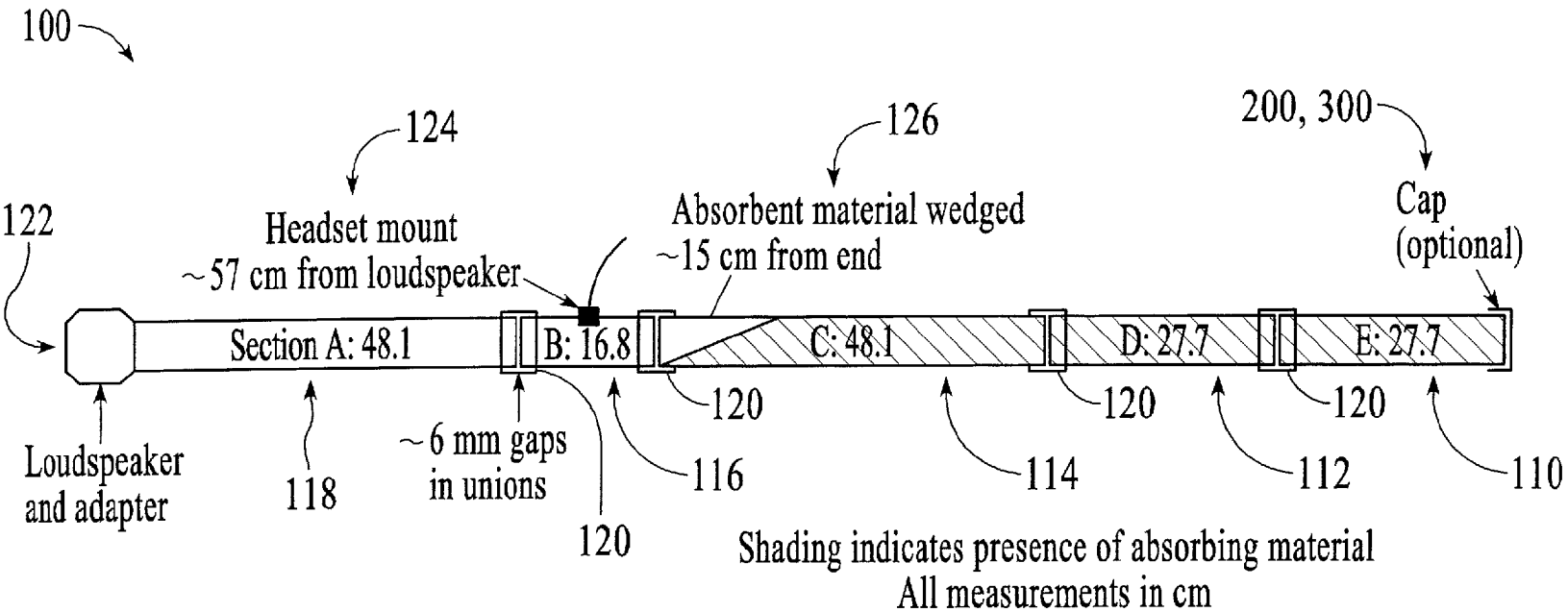
FIG. 17 shows an absorbent enablement with each section labeled with a letter and a length (see FIG. 29 for other configurations), under an embodiment.

An embodiment using acoustic absorption is shown in FIG. 17, which shows an absorbent enablement with each section labeled with a letter and a length (110-118), under an embodiment. The headset mount 124 was placed about 57 cm from the loudspeaker 122 for this embodiment. Absorbing material (Bonded Absorbing Cotton (BAC) material 126 under the embodiment of FIG. 17) is contained in sections C 114, D 112 and E 110. The absorbing material 126 is wedged for about 15 cm at the end of Section C 114 nearest the headset to reduce reflections from the BAC. Five 2.0 inch inside diameter pipes 110-118 and four unions 120 are used and each pipe section (110-118) is designated by letters. In this embodiment, Section A (118) is 48.1 cm long, Section B (116) 16.8 cm, Section C (114) 48.1 cm, Section D (112) 27.7 cm, and Section E (110) 27.7 cm but the embodiment is not so limited. A cap 200, 300 may be positioned over the end of the embodiment opposite loudspeaker 122. Section lengths that have resulted in adequate performance are summarized in the table of FIG. 29 as further described below.

Figure 18:
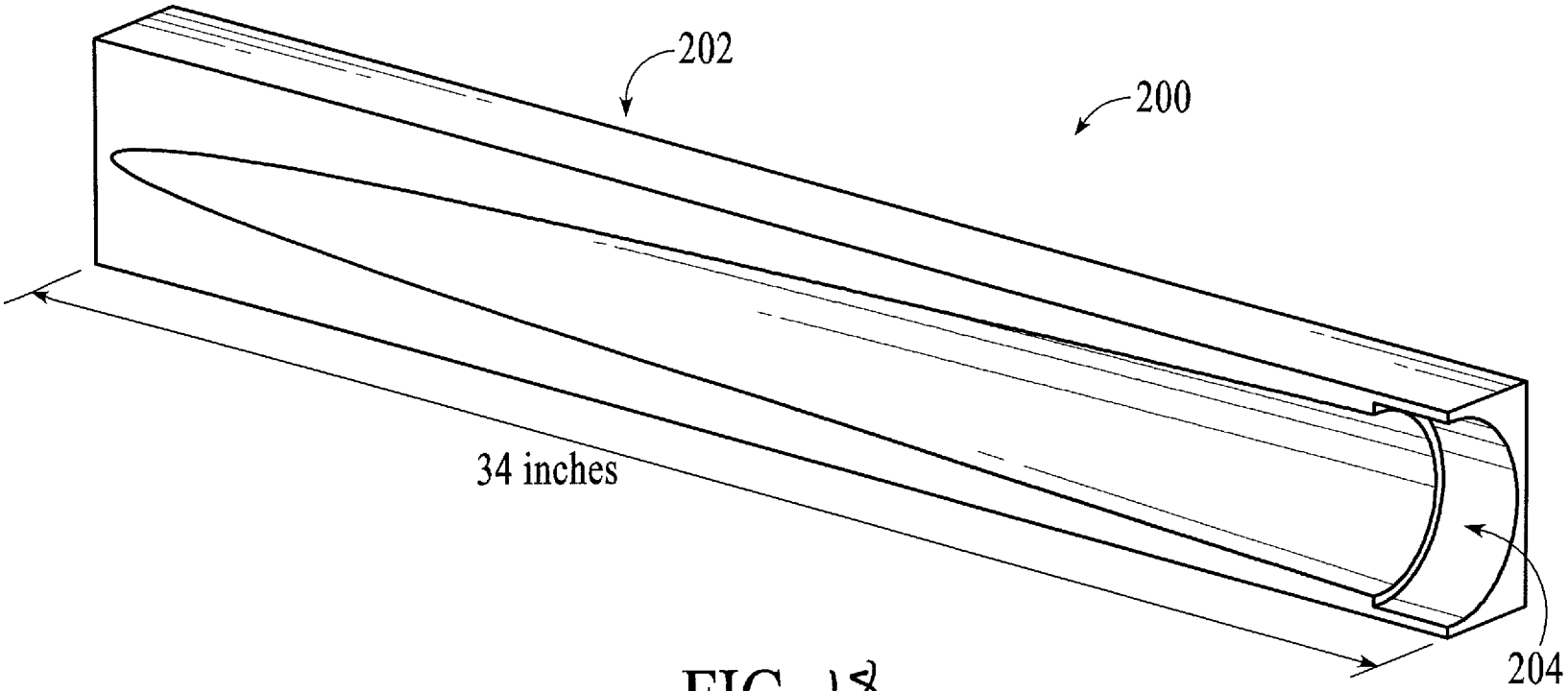
FIG. 18 is a cross-section of a CAD model for a linearly decreasing cross-sectional area four-inch inside diameter pipe end cap that widens the resonance widths by reflecting energy all along its length, under an embodiment.

For resonant embodiments, a tapered end cap is used where wider resonances are desired. A tapered end cap is one where the inside diameter of the pipe is configured such that there are multiple reflections from the cap. A smoothly tapering cap embodiment is shown in FIG. 18. Here the inside diameter changes linearly as a function of length, so that there are multiple reflections of energy along the length of the cap.

FIG. 18 shows a cross-section of a CAD model for a linearly decreasing cross-sectional area four-inch inside diameter pipe end cap 202, under an embodiment. This end cap 202 will widen the resonance widths by reflecting energy all along its length. Total tapered length of this embodiment is approximately 34 inches, but can vary from approximately 2 inches to more than 34 inches depending on the application. The indentation 204 at the end is a slip fit for a 4 inch I.D. pipe, and the slip fit is configured so that the transition between the pipe and the tapered end is as smooth as possible.

Figure 19:
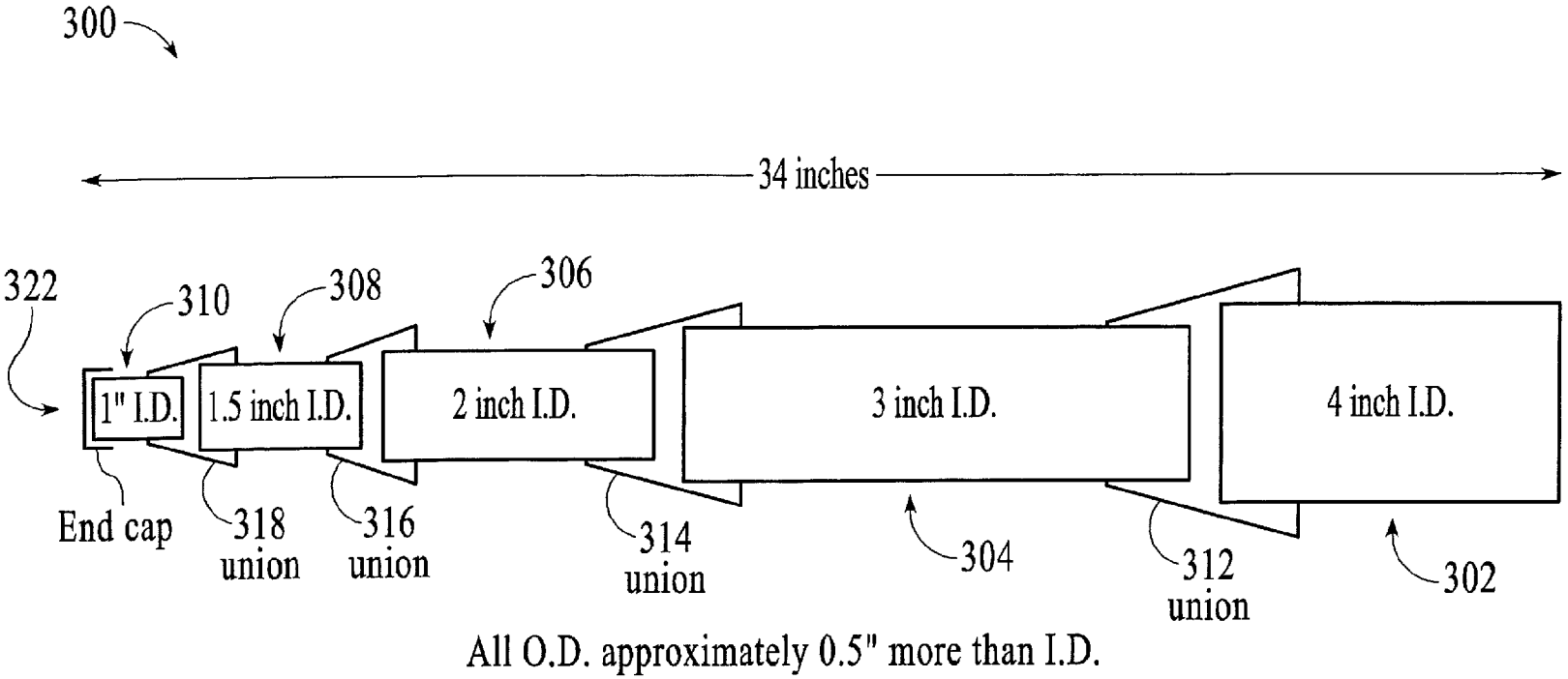
FIG. 19 shows a piecewise tapered approximation to the smoothly tapered end cap shown in FIG. 18 for a four-inch inside diameter pipe (approximately to scale), under an embodiment.

If constructing the smoothly tapering cap is too difficult and/or expensive, a piecewise approximation 322 can easily be constructed using reducers. The embodiment of FIG. 19 implements the piecewise approximation by joining five pipe sections 302-310 of decreasing I.D. dimensions. As shown in FIG. 19, sections 302, 304, 306, 308 and 310 exhibit I.D. dimensions of 4 inches, 3 inches, 2 inches, 1.5 inches, and 1 inch, respectively. The pipe sections 302-310 are joined using corresponding union components 312-318. The tapering cap 322 of the FIG. 19 embodiment is 34 inches in length but the embodiment is not so limited. Each time the inside diameter of the embodiment changes some of the acoustic energy is reflected. This configuration has the advantage of being simple and inexpensive to produce, but the number of additional reflections is limited. Both caps 200, 300 reduce the amplitude and increase the width of the resonances, which can make it simpler for calibration algorithms to work accurately.

As described above, FIG. 19 is a piecewise tapered approximation to the smoothly tapered end cap shown in FIG. 18 for a four-inch inside diameter pipe (approximately to scale), under an embodiment. This is simpler and less expensive to build, but does not broaden the plateaus as much as the smoothly tapered configuration.

FIG. 29 is a table of lengths of different sections 1410 for various combinations of straight pipes tested, the total length 1420 (not including loudspeaker and adapter), and the microphone sampling point 1430, under an embodiment. The sampling frequency was 4 kHz and the cutoff of the excitation used was 3700 Hz. The total length 1420 includes approximately 6 mm for each union used. A length of 0.0 cm indicates removal. As shown in FIG. 17, Section A 118 is the section closest to the loudspeaker and Section B 116 is the section where the headset mount is located. Sections C 114, D 112, and E 110 are all filled with the absorbent material 126. All comparisons were to the first combination. "Degraded" denotes a calibration that was significantly different than the semi-anechoic calculation, and "disturbances" indicate small (up to approximately 0.3 dB) differences in the frequency spectrum of $O_1$ and $O_2$ that were different than that recorded in the semi-anechoic chamber. Many different combinations are possible; this list is not exhaustive and is intended only to display the flexibility of the calibration methods of an embodiment.

Many combinations are possible, but the critical lengths are Sections A 118 and C 114. In practice, the headset needs to be about 30 cm away from the loudspeaker to minimize loudspeaker near-field effects on the results. Thus Section A 118 and B 116 should be sized so that the microphones are at least 30 cm from the loudspeaker. For Section C 114, for best performance enough absorbent material should be used so that the amount of acoustic energy returning to the headset from the far end of the pipe is at least 40 dB lower than the energy coming from the loudspeaker 122. This length will vary depending on the absorber. For this embodiment, the minimum length for good performance was about 48 cm. Multiple sections were used for the absorbent length to ease installation of the absorbent material 126. This particular configuration is recommended because it has demonstrated excellent accuracy, repeatability, noise robustness, and is not too long. Extra absorbent sections are allowable but generally not necessary. The use of less absorbent material than shown is possible if space is a consideration at the cost of slightly less noise robustness and increased risk of resonant spikes in the frequency spectrum.

The absorbent material 126 used was 2 inch thick Bonded Absorbent Cotton (BAC), available from Acoustical Surfaces Incorporated (part number EE224B3, phone number 800-448-9077) in four foot by two foot sheets. The sheets were cut into 2 inch strips that were 48 inches long, and then cut to length to fit each of the sections. The strips were fed into the sections, and double-sided tape was used to secure one side of the tape on both ends. Other means of securing the BAC 126 are possible (even using friction between the BAC 126 and the pipe itself) and the method of adhesion is not critical to the performance of the system. It is recommended that the BAC 126 be installed so that it is distributed uniformly in the pipe with no bunching of the material. It does not need to fill the pipe completely, but there should be no large gaps. It is also recommended that the end of the BAC 126 nearest the microphone sampling point be wedged so that reflections due to the change in impedance caused by the BAC 126 are minimized. Other absorbent material such as fiberglass can be used. The only important performance metric is that the reflections from the end of the pipe be minimized as stated above.

It is recommended for maximum performance that the three sections of absorbent pipe be oriented so that their taped surfaces are opposite one another. That is, Section C 114 is rotated so that the taped wedge side is opposite the microphones and Section D 112 is rotated so that its taped surface is opposite that of Sections C 114 and E 110.

Figure 20:
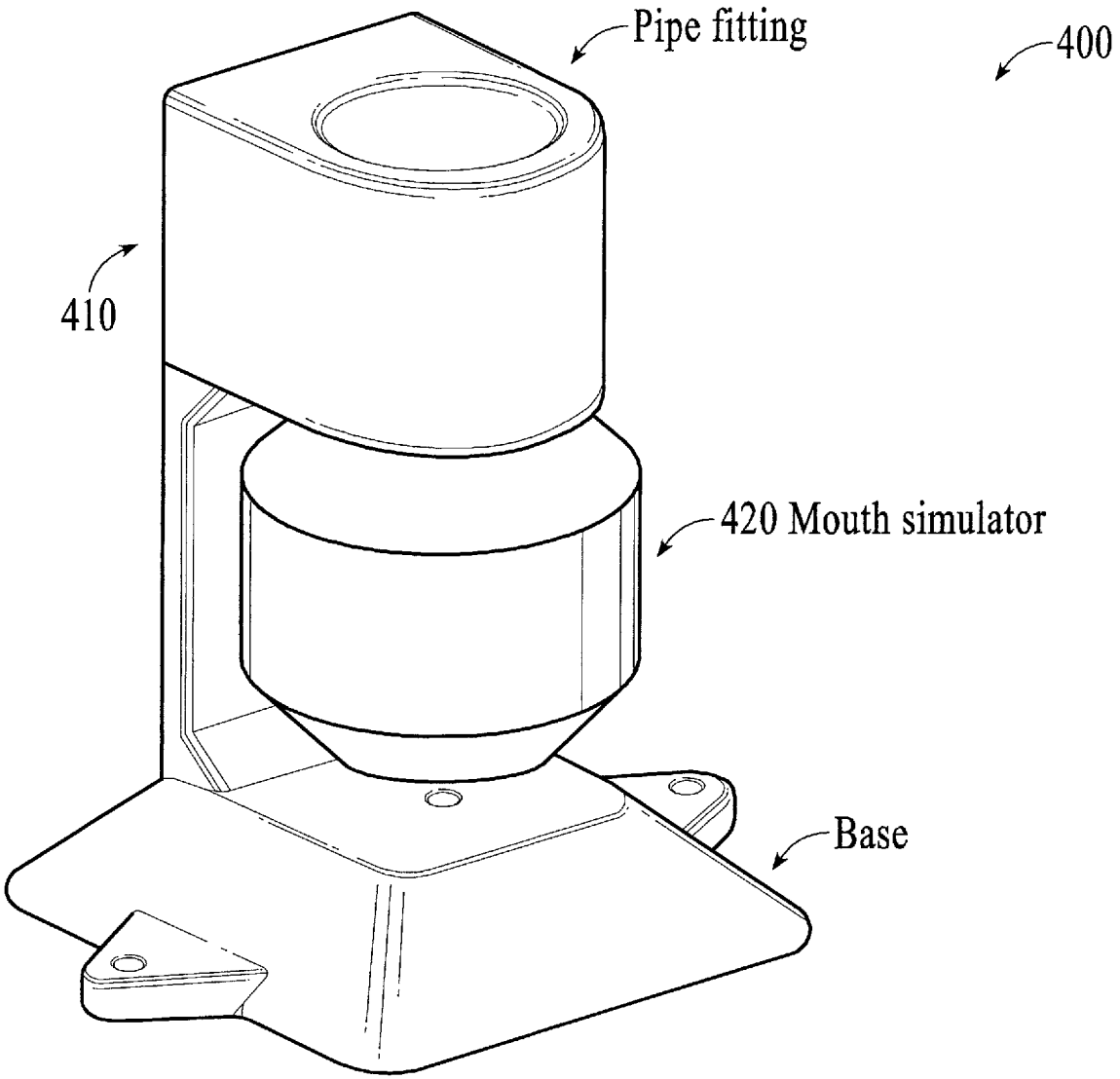
FIG. 20 shows the pipe-to-loudspeaker adapter used for the enablement tests, under an embodiment.

FIG. 20 shows the pipe-to-loudspeaker adapter 410 (PLA), under an embodiment. It is configured for use with a Bruel and Kjaer Mouth Simulator 420, model 4227, but any suitable loudspeaker may be used. The Bruel and Kjaer mouth simulator 420 loudspeaker is shown in place, and is held there with two bolts—one through the base and the other through the back of the adapter (not seen here). The PLA 410 uses a rubber O-ring to seal the surface of the loudspeaker against the surface of the PLA 410, and a slip fit to seal the pipe at the other end. The pipe may be glued to the PLA 410 as well. Two nylon bolts with metal nuts are used to hold the Mouth Simulator 420 in place. Any PLA 410 which holds the loudspeaker and the pipe in a fixed position may be used.

When using the Bruel and Kjaer Mouth Simulator 420 model 4227, it is recommended that Section A 118 be at least approximately 28 cm long to reduce near-field effects that can cause the calibration filter to be inaccurate at certain frequencies. For best performance, approximately 48.1 cm is recommended, but for most applications approximately 28 cm is sufficient. Lengths down to 0 cm were tested for Section A 118, with the best performance observed between approximately 28 and 48.1 cm.

Testing was done using the Aliph Jawbone Icon headset, available at http://www.jawbone.com. The Icon includes two omnidirectional microphones situated approximately 25 mm apart and calibration is performed for operation. A mount was constructed that held the Icon so that each microphone was at the same relative distance from the pipe wall (approximately 5 mm) and the same distance from the loudspeaker. Using the headset mount described above with reference to FIG. 2, the two microphones of the headset were positioned approximately 5 mm inside the inside surface of the pipe and an equal distance from the loudspeaker end of the pipe. Data was recorded using sampling rates of 8 kHz and 16 kHz. Calibration filters were calculated using a 16-subband LMS adaptive filter algorithm, using $O_1$ (the front microphone) as the desired signal.

Figure 21:
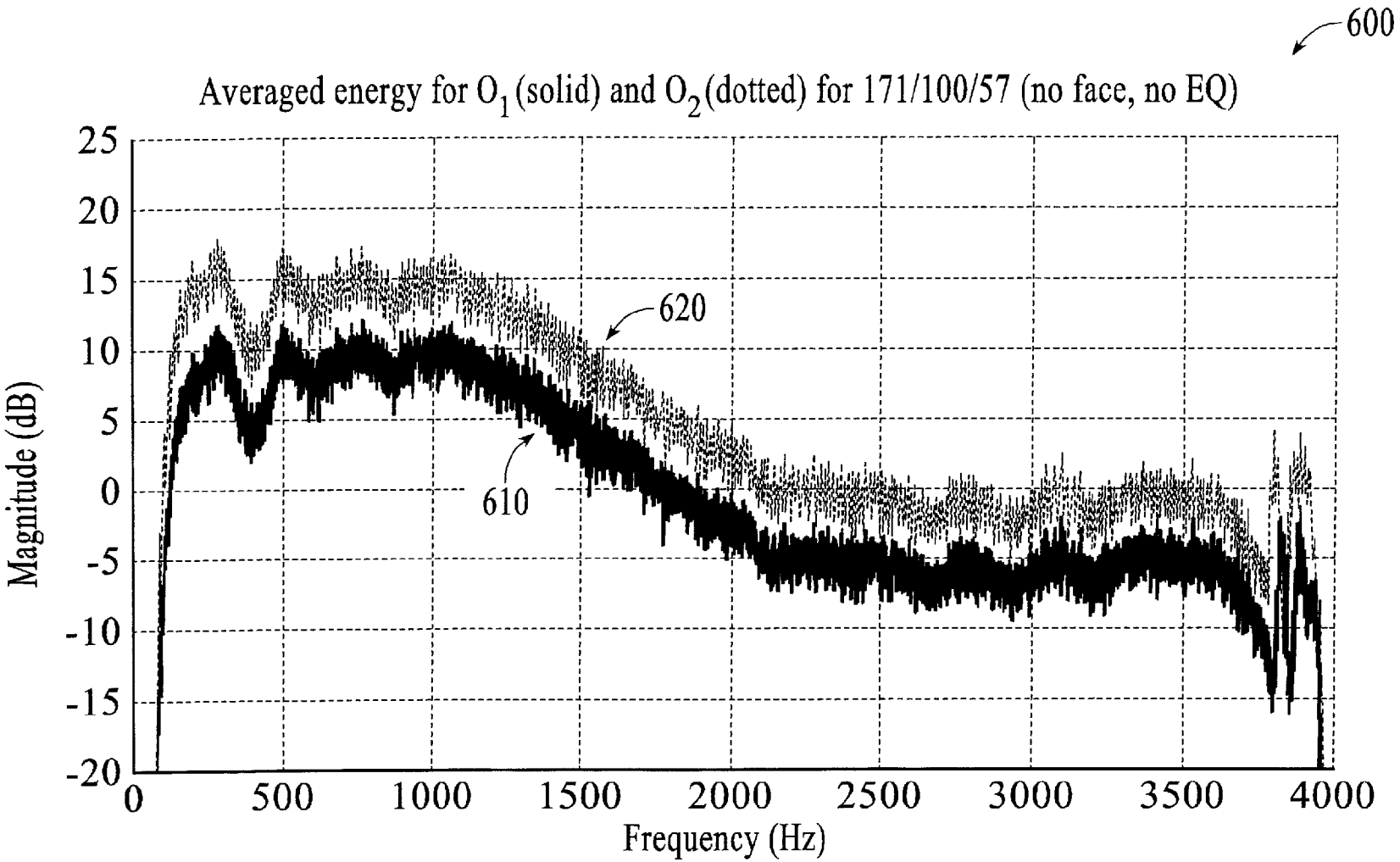
FIG. 21 is a plot of averaged energy versus frequency for $O_1$ (solid) and $O_2$ (dotted) for headset 2259 in the absorbent embodiment with no equalization, under an embodiment.

FIG. 21 shows a plot of the averaged energy calculated using the Fast Fourier Transform (FFT) versus frequency data for $O_1$ (solid) 610 and $O_2$ (dotted) 620 using test headset 2259 in the absorbent embodiment with no equalization, under an embodiment. The excitation has not been whitened for this experiment. The microphone (energy) responses are relatively smooth (there are no significant resonances, as would normally be expected inside a pipe, due to the absorbent material) and relatively similar in energy.

Figure 22:
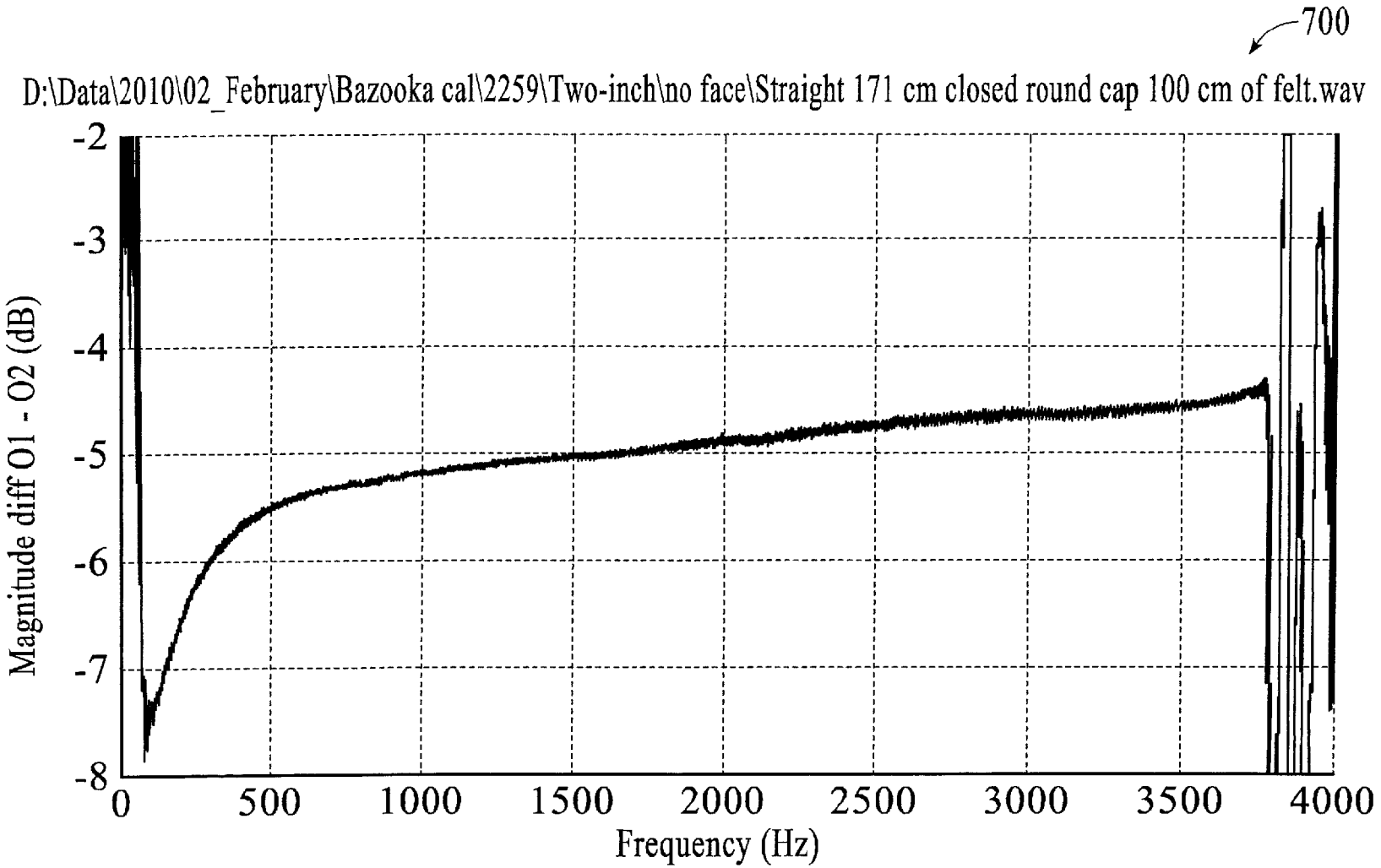
FIG. 22 is a plot of the differences in the plots in FIG. 21, under an embodiment.

FIG. 22 shows a plot of the difference in the energy versus frequency data of $O_1$ and $O_2$, under an embodiment. The difference in the frequency response of the two microphones $O_1$ and $O_2$ is relatively smooth throughout the usable spectrum (approximately 100 to 3750 Hz), with no jumps or discontinuities.

Figure 23:
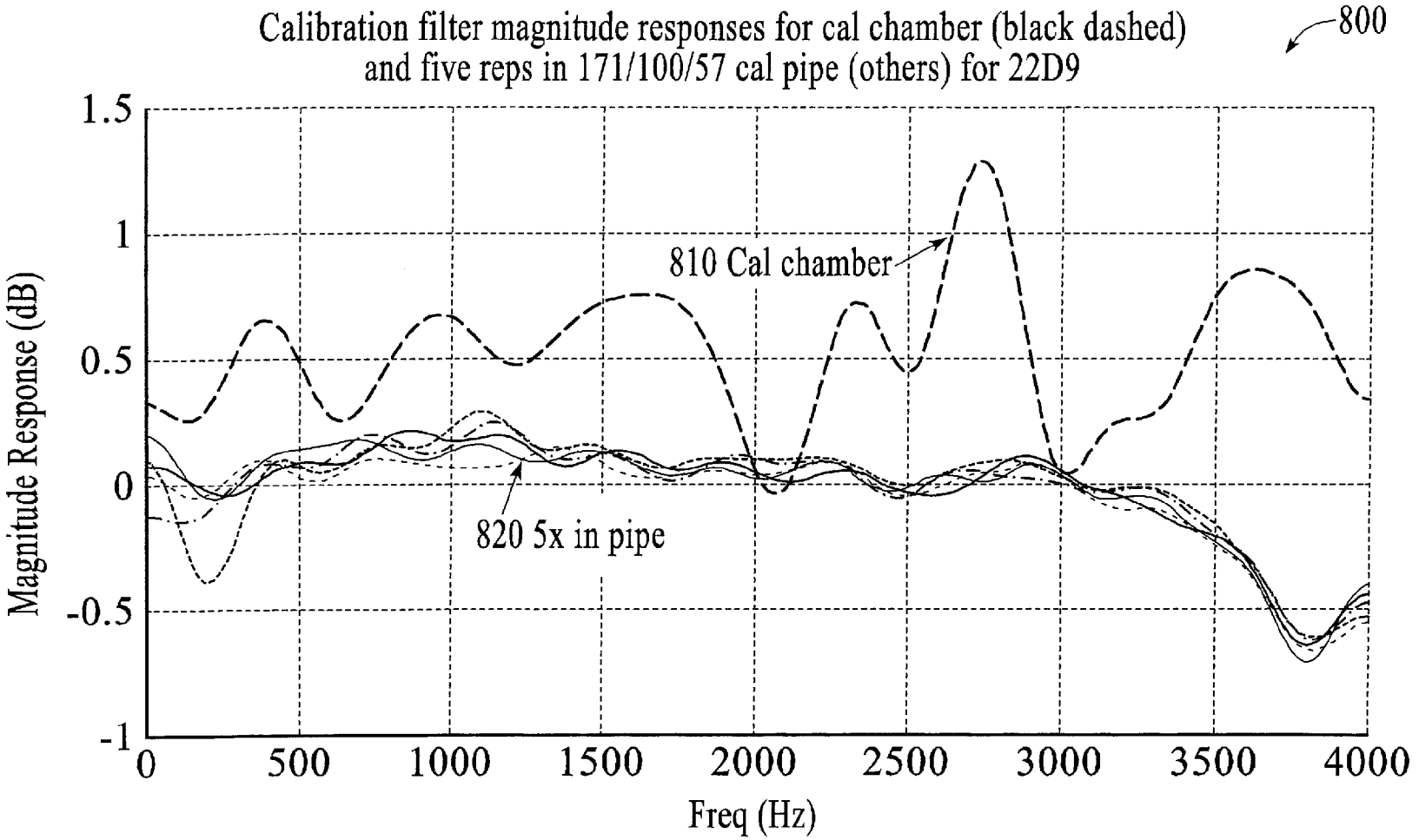
FIG. 23 is a plot of calibration filter magnitude responses for a conventional calibration chamber (black dashed) and five repetitions in the absorbent embodiment (all others) for headset 22D9, under an embodiment.

FIG. 23 shows a plot of the magnitude response of the calibration filter derived from the $O_1$ and $O_2$ data, under an embodiment. The amplitude response is derived using a conventional calibration chamber denoted using a dashed black plot 810 and five remove-and-replace repetitions 820 in the absorbent pipe embodiment included for comparison, for headset 22D9. Note the relatively large ripple and offset in magnitude when using the conventional calibration chamber 810, and the tight grouping of the remove-and-replace pipe calibration 820. The performance of the pipe-calibrated headset was significantly better than the calibration chamber headset.

Figure 24:
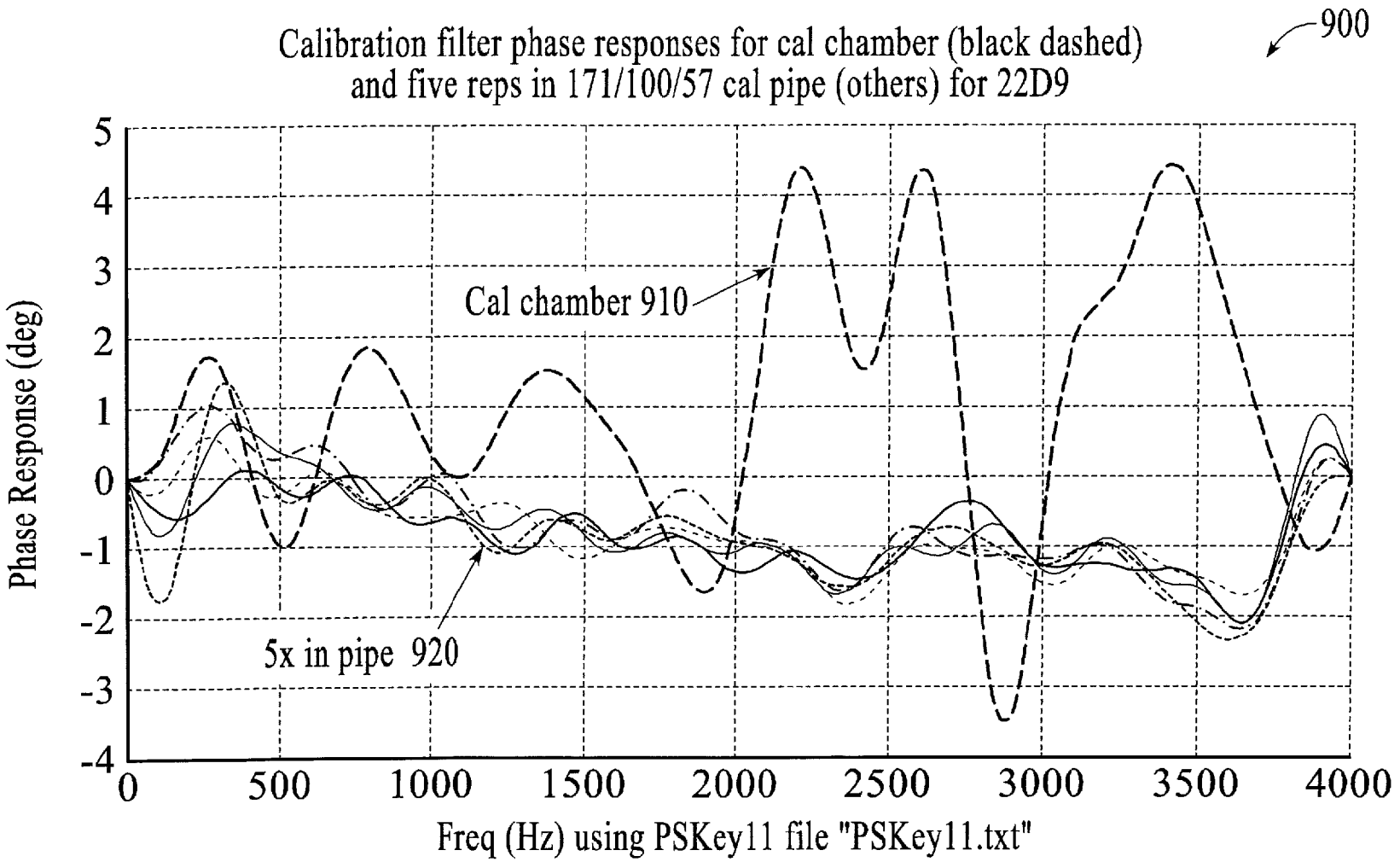
FIG. 24 is a plot of calibration filter phase responses for a conventional calibration chamber (black dashed) and five repetitions in the absorbent embodiment (all others) for headset 22D9, under an embodiment.

FIG. 24 shows the calibration filter phase responses for the conventional calibration chamber (black dashed) 910 and five repetitions in the absorbent embodiment (all others) 920 for headset 22D9, under an embodiment. Again, the conventional calibration chamber result (black dashed) 910 has a relatively larger ripple than the pipe calibrations, and a tight grouping is present with the remove-and-replace pipe calibration 920. For both magnitude and phase, the pipe calibrations have fewer ripples and excellent repeatability. Using the same headset, significantly higher noise suppression performance was noted when using any of the pipe calibrations compared to the conventional calibration chamber calibration. This indicates that not only is the pipe calibration relatively smoother with fewer ripples, it is also relatively more accurate.

Figure 25:
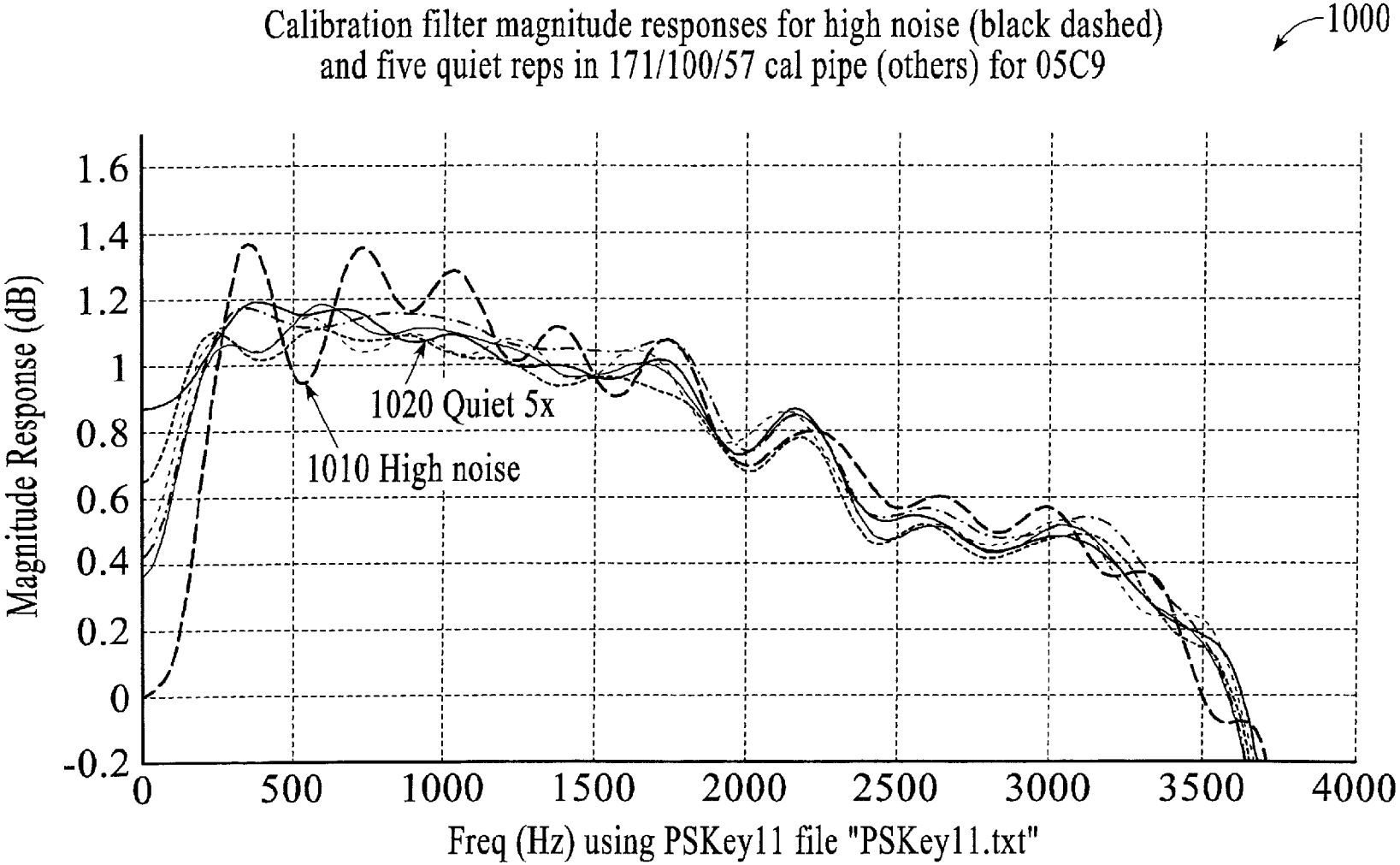
FIG. 25 is a plot of calibration filter magnitude responses for high factory noise simulation (black dashed) and five repetitions in quiet (all others) for the absorbent pipe embodiment using headset 05C9, under an embodiment.

As a test to the noise resistance of the configuration, a large subwoofer was used to drive a recorded factory noise pink signal (most energy was below 200 Hz) at 81 dBA as measured at the headset. This level is much higher than is actually experienced in the factory in which it was recorded. FIG. 25 shows the resulting magnitude responses of the calibration filter for the absorbent pipe embodiment using test headset 05C9, under an embodiment. The relatively high noise simulation is denoted using the black dashed line 1010, and five remove-and-replace repetitions 1020 in quiet are included for comparison. Note only a relatively small (approximately +−0.2 dB) increase in ripple at low frequencies in this very high noise simulation.

Figure 26:
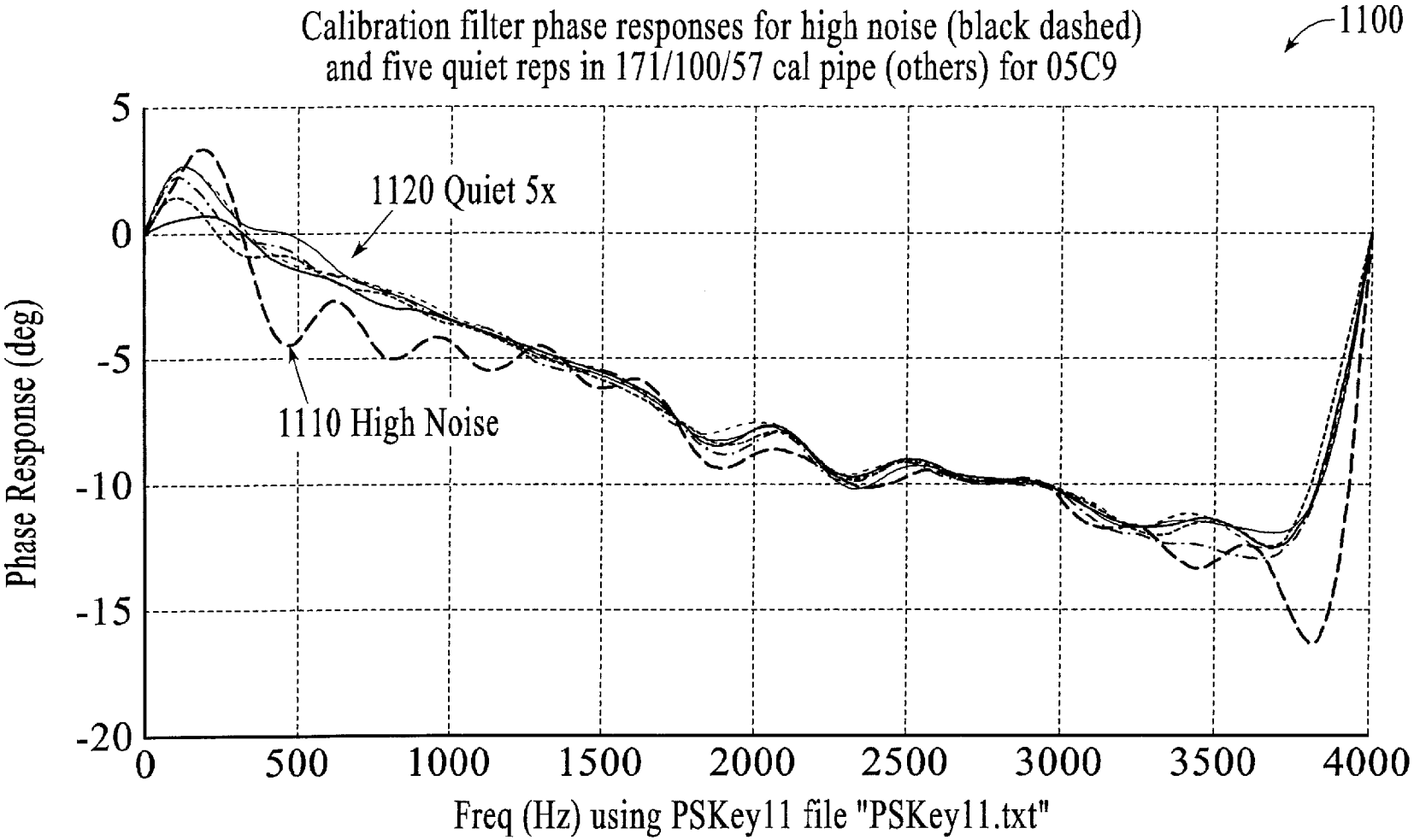
FIG. 26 is a plot of calibration filter phase responses for high factory noise simulation (black dashed) and five repetitions in quiet (all others) for the absorbent pipe embodiment using headset 05C9, under an embodiment.

FIG. 26 shows the calibration filter phase responses for relatively high factory noise simulation (black dashed) 1110 and five repetitions in quiet (all others) 1120 for the absorbent pipe embodiment using headset 05C9, under an embodiment. There is slightly more ripple (only a small (approximately +−3 degrees) increase in ripple at low frequencies in this relatively very high noise simulation) and some disturbances due to the very high noise levels, but overall the performance is still very good and there were little differences noted in the performance of the headset using noisy and quiet calibrations.

A second embodiment uses the same configuration as the embodiment described above, but does not use the absorbent BAC. The result is a more reverberant environment, but one that is very resistant to external noise. Any noise that does get into the pipe only serves to add to the reverberation being generated by the loudspeaker and does not significantly affect the relative amplitude or phase presented to the microphones. Thus, this configuration may be used in almost any noise environment.

Figure 27:
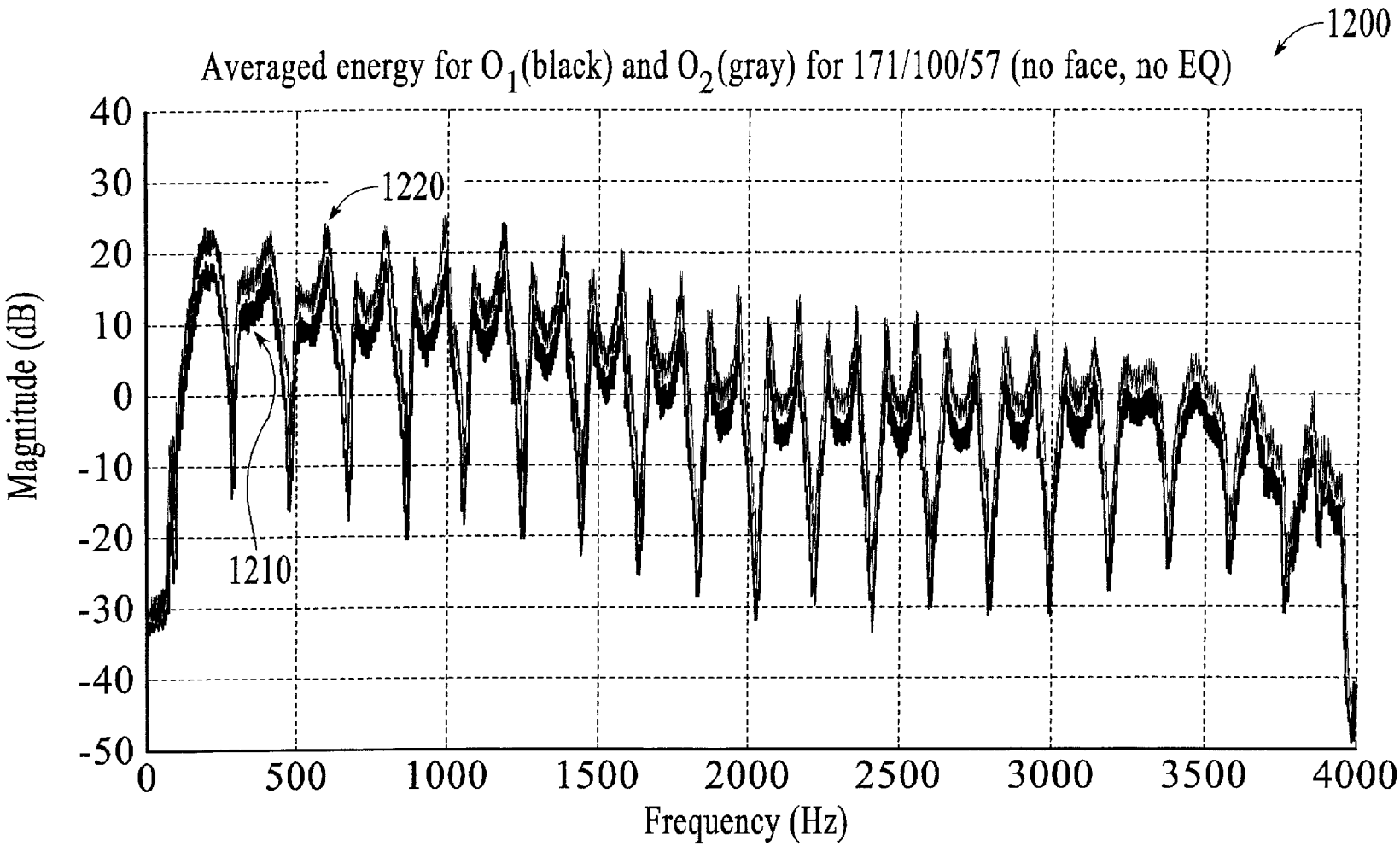
FIG. 27 is a plot of averaged energy versus frequency for $O_1$ (black) and $O_2$ (gray) for headset 2259 in the reverberant embodiment with no equalization, under an embodiment.

FIG. 27 shows a plot of the averaged energy calculated using the Fast Fourier Transform (FFT) versus frequency data for $O_1$ (black) 1210 and $O_2$ (gray) 1220 using test headset 0C59 in the reverberant embodiment with no equalization, under an embodiment. Significant resonances are present (compare to FIG. 21) but the peak locations are approximately the same and consistent in height, and the energy at the null locations exhibits some differences.

Figure 28:
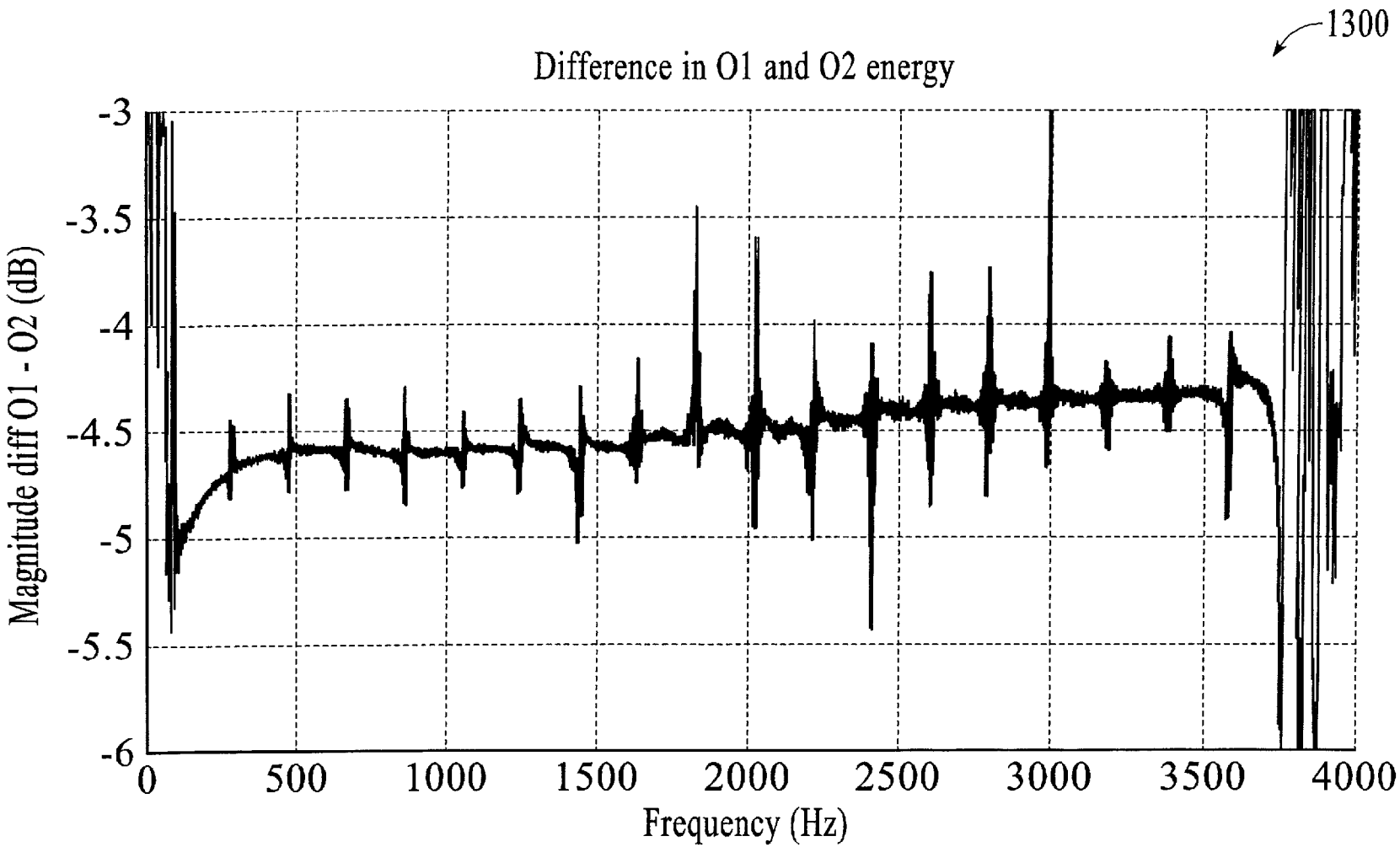
FIG. 28 is a plot of the differences in the plots in FIG. 27, under an embodiment.

This is made clear in FIG. 28, which shows a plot of the difference in the energy versus frequency (differences in plots 1210, 1220 of FIG. 27), under an embodiment. At the resonance locations, the differences are consistent, but near the nulls the differences can vary by up to approximately 1.5 dB. However, since most calibration algorithms use the frequencies with the most energy to calculate the calibration filters, this should not prove an undue burden on the calibration algorithm.

Embodiments described herein include a system including a pipe comprising at least one section that spans between a first end and a second end of the pipe. The pipe has a cylindrical cross-section. The system includes a mount comprising a receptacle positioned in the pipe a first distance from the first end and a second distance from the second end. The receptacle receives a device having at least one microphone that is to be calibrated and secures the at least one microphone a third distance inside an inside surface of the pipe. The system includes a clamp attached to the mount and comprising a first arm rotateably coupled to a second arm that controls the first arm between an open position and a closed position. The system includes a platform and a spindle connected to the first arm. The spindle includes a cushion tip on a distal end. When the device is present in the receptacle and the first arm is in the closed position the cushion tip contacts the device and seats the device in the receptacle. The system includes an adapter connected to the first end that connects a loudspeaker to the pipe. The pipe controls an acoustic energy experienced by the plurality of microphones so that each microphone of the plurality of microphones receives equivalent acoustic energy.

Embodiments described herein include a system comprising: a pipe comprising at least one section that spans between a first end and a second end of the pipe, wherein the pipe has a cylindrical cross-section; a mount comprising a receptacle positioned in the pipe a first distance from the first end and a second distance from the second end, wherein the receptacle receives a device having at least one microphone that is to be calibrated and secures the at least one microphone a third distance inside an inside surface of the pipe; a clamp attached to the mount and comprising a first arm rotateably coupled to a second arm that controls the first arm between an open position and a closed position; a platform and a spindle connected to the first arm, wherein the spindle includes a cushion tip on a distal end, wherein when the device is present in the receptacle and the first arm is in the closed position the cushion tip contacts the device and seats the device in the receptacle; and an adapter connected to the first end that connects a loudspeaker to the pipe, wherein the pipe controls an acoustic energy experienced by the plurality of microphones so that each microphone of the plurality of microphones receives equivalent acoustic energy.

The mount of an embodiment comprises a pipe section having a length and an inside diameter, wherein the pipe section has a cylindrical cross-section.

The inside diameter of the pipe of an embodiment is approximately in a range of two (2) inches to four (4) inches.

When the device of an embodiment is secured in the receptacle at least a portion of the device is positioned a first distance inside the pipe section.

The first distance of an embodiment is approximately in a range of two (2) millimeters to five (5) millimeters.

The mount of an embodiment comprises a curved surface defining an inner region and an outer region, wherein when the mount is connected to a calibration pipe having a cylindrical cross-section a curvature of the curved surface mates with the calibration pipe and the inner region corresponds to an inner environment of the calibration pipe.

An inside diameter of the calibration pipe of an embodiment is approximately in a range of two (2) inches to four (4) inches.

When the device of an embodiment is secured in the receptacle at least a portion of the device is positioned in the inner environment of the calibration pipe a first distance from the curved surface.

The first distance of an embodiment is approximately in a range of two (2) millimeters to five (5) millimeters.

The receptacle of an embodiment is in a shape of a housing of the device.

The receptacle of an embodiment includes a cutout that positions the device so that a first portion of the device is exposed to a first region adjacent to a first side of the mount and a second portion of the device is exposed to a second region adjacent to a second side of the mount.

When the device of an embodiment is present in the receptacle and the first arm is in the closed position an attached position at which the clamp is attached to the mount results in the cushion tip pulling the device back toward a base of the clamp and securing the device in the receptacle.

The clamp of an embodiment comprises a third arm rotateably connected to the first arm and to the second arm, wherein movement of the second arm is translated via the third arm to control the first arm between the open position and the closed position.

The platform of an embodiment comprises a first surface having a first orifice that accepts the spindle.

The spindle of an embodiment is secured to the platform and to the first arm of the clamp.

The spindle of an embodiment connects the platform to the first arm of the clamp.

The platform of an embodiment comprises at least one tab, wherein the at least one tab contacts at least one side of the first arm to secure a position of the platform relative to the first arm.

The at least one tab of an embodiment comprises a first tab, wherein the first tab contacts a first side of the first arm.

The at least one tab of an embodiment comprises a first tab and a second tab, wherein the first tab contacts a first side of the first arm and the second tab contacts a second side of the first arm.

The at least one tab of an embodiment is formed from a portion of the platform.

The at least one tab of an embodiment comprises a second surface that is approximately perpendicular to the first surface of the platform.

The platform of an embodiment comprises a second orifice that is positioned a second distance from the first orifice.

The system of an embodiment comprises a second spindle, wherein the second orifice accepts the second spindle.

The second spindle of an embodiment includes a second cushion tip on a distal end.

When the device of an embodiment is positioned in the receptacle and the first arm is in the closed position the cushion tip of the spindle and the second cushion tip of the second spindle contact the device and secure the device in the receptacle.

The cushion tip of an embodiment comprises a flat tip.

The cushion tip of an embodiment comprises a conical tip.

The second cushion tip of an embodiment comprises a flat tip.

The second cushion tip of an embodiment comprises a conical tip.

The platform of an embodiment comprises metal.

The platform of an embodiment comprises stainless steel.

The system of an embodiment comprises a calibration pipe and a loudspeaker connected to the mount.

The device of an embodiment comprises at least one microphone, wherein the at least one microphone is calibrated while seated in the receptacle.

The device of an embodiment comprises a plurality of microphones, wherein the receptacle locates each microphone of the plurality of microphones an equal distance from the loudspeaker and the plurality of microphones are calibrated while seated in the receptacle.

The at least one section of an embodiment comprises a single section.

The at least one section of an embodiment comprises a plurality of sections.

The plurality of sections of an embodiment comprises five sections.

A first section of an embodiment comprises the first end, a second section is coupled to the first section and comprises the receptacle, and a fifth section comprises the second end.

The system of an embodiment comprises a third section coupled to the second section, wherein the first section and the third section have an equivalent length.

A length of the first section and the third section of an embodiment is approximately 48 centimeters.

A length of the second section of an embodiment is approximately 17 centimeters.

The system of an embodiment comprises a fourth section coupled to the third section, wherein the fifth section is coupled to the fourth section, wherein the fourth section and the fifth section have an equivalent length.

A length of the fourth section and the fifth section of an embodiment is approximately 28 centimeters.

The system of an embodiment comprises an absorbing material positioned between the receptacle and the second end of the pipe.

The absorbing material of an embodiment is positioned inside at least a portion of the pipe comprising the third section, the fourth section, and the fifth section.

The absorbing material in the third section of an embodiment is wedged at an end nearest the receptacle.

The first distance of an embodiment is approximately 57 centimeters.

The plurality of sections of an embodiment comprises four sections.

A first section of an embodiment comprises the first end, and a second section is coupled to the first section and comprises the receptacle.

A length of the second section of an embodiment is approximately 17 centimeters.

The system of an embodiment comprises a third section coupled to the second section.

A length of the third section of an embodiment is approximately 48 centimeters.

The system of an embodiment comprises a fourth section coupled to the third section, wherein the first section and the fourth section have an equivalent length.

A length of the first section and the fourth section of an embodiment is approximately 28 centimeters.

The first distance of an embodiment is approximately 37 centimeters.

The plurality of sections of an embodiment comprises three sections.

A first section of an embodiment comprises the first end, and a second section is coupled to the first section and comprises the receptacle.

A length of the second section of an embodiment is approximately 17 centimeters.

The system of an embodiment comprises a third section coupled to the second section, wherein the first section and the third section have an equivalent length.

A length of the first section and the third section of an embodiment is approximately 48 centimeters.

The first distance of an embodiment is approximately 57 centimeters.

A length of the first section and the third section of an embodiment is approximately 28 centimeters.

The first distance of an embodiment is approximately 37 centimeters.

The system of an embodiment comprises a third section coupled to the second section, wherein the first section and the third section have different lengths.

A length of the first section of an embodiment is approximately 48 centimeters.

A length of the third section of an embodiment is approximately 28 centimeters.

A length of the second section of an embodiment is approximately 17 centimeters.

The first distance of an embodiment is approximately 57 centimeters.

A length of the first section of an embodiment is approximately 28 centimeters.

A length of the third section of an embodiment is approximately 48 centimeters.

A length of the second section of an embodiment is approximately 17 centimeters.

The first distance of an embodiment is approximately 37 centimeters.

A length of the first section of an embodiment is approximately 15 centimeters.

A length of the third section of an embodiment is approximately 28 centimeters.

A length of the second section of an embodiment is approximately 17 centimeters.

The first distance of an embodiment is approximately 24 centimeters.

A first section of an embodiment comprises the first end and the receptacle.

The system of an embodiment comprises a second section coupled to the first section, and a third section coupled to the second section, wherein the third section comprises the second end.

A length of the first section of an embodiment is approximately 17 centimeters.

A length of the second section of an embodiment is approximately 48 centimeters.

A length of the third section of an embodiment is approximately 28 centimeters.

The first distance of an embodiment is approximately 8 centimeters.

The plurality of sections of an embodiment comprises two sections.

A first section of an embodiment comprises the first end and the receptacle.

The system of an embodiment comprises a second section coupled to the first section, wherein the second section comprises the second end.

A length of the first section of an embodiment is approximately 17 centimeters.

A length of the second section of an embodiment is approximately 48 centimeters.

The first distance of an embodiment is approximately 8 centimeters.

A length of the second section of an embodiment is approximately 28 centimeters.

The first distance of an embodiment is approximately 8 centimeters.

The first distance of an embodiment is at least 30 centimeters.

The second end of an embodiment is open.

The second end of an embodiment is coupled to a cap, wherein the cap closes the second end.

The cap of an embodiment is tapered.

An inside diameter of the cap of an embodiment changes linearly as a function of a length of the cap.

The length of the cap of an embodiment is approximately in a range of two (2) inches to 34 inches.

An inside diameter of the pipe of an embodiment is approximately in a range of two (2) inches to four (4) inches.

The third distance of an embodiment is approximately in a range of two (2) to five (5) millimeters.

The at least one microphone of an embodiment comprises a plurality of microphones, wherein the receptacle locates each microphone of the plurality of microphones an equal distance from the loudspeaker.

The system of an embodiment comprises an absorbing material positioned inside at least a portion of the pipe.

The absorbing material of an embodiment is positioned between the receptacle and the second end of the pipe.

The absorbing material of an embodiment is wedged at an end nearest the receptacle.

An amount of the absorbing material of an embodiment is an amount that lowers an amount of reflected acoustic energy returning to the plurality of microphones from the second end at least 40 decibels lower than acoustic energy projected from the first end.

The absorbing material of an embodiment comprises bonded absorbent cotton.

The loudspeaker of an embodiment is a mouth simulator loudspeaker.

The at least one section of an embodiment is straight.

The at least one section of an embodiment is curved.

The equivalent acoustic energy of an embodiment comprises equivalent amplitude and phase.

Embodiments described herein include a system comprising a mount comprising a receptacle. When a device is introduced to the mount the receptacle receives at least a portion of a device. The system includes a clamp attached to the mount and comprising a first arm rotateably coupled to a second arm that controls the first arm between an open position and a closed position. The system includes a platform and a spindle connected to the first arm. The spindle includes a cushion tip on a distal end. When the device is present in the receptacle and the first arm is in the closed position the cushion tip contacts the device and seats the device in the receptacle.

Embodiments described herein include a system comprising: a mount comprising a receptacle, wherein when a device is introduced to the mount the receptacle receives at least a portion of a device; a clamp attached to the mount and comprising a first arm rotateably coupled to a second arm that controls the first arm between an open position and a closed position; and a platform and a spindle connected to the first arm, wherein the spindle includes a cushion tip on a distal end, wherein when the device is present in the receptacle and the first arm is in the closed position the cushion tip contacts the device and seats the device in the receptacle.

Embodiments described herein include a system comprising a mount comprising a receptacle. The mount comprises a pipe section having a cylindrical cross-section. When a device is introduced to the mount the receptacle receives at least a portion of a device. The system includes a clamp attached to the mount and comprising a load arm rotateably coupled to a lever arm that controls the load arm between an open position and a closed position. The system includes at least one spindle connected to the load arm. The at least one spindle includes a cushion tip on a distal end. When the device is present in the receptacle and the load arm is in the closed position the cushion tip contacts the device and seats the device in the receptacle.

Embodiments described herein include a system comprising a mount comprising a receptacle. The mount comprises a pipe section having a cylindrical cross-section. When a device is introduced to the mount the receptacle receives at least a portion of a device. The system includes a clamp attached to the mount and comprising a load arm rotateably coupled to a lever arm that controls the load arm between an open position and a closed position. The system includes at least one spindle connected to the load arm. The at least one spindle includes a cushion tip on a distal end. When the device is present in the receptacle and the load arm is in the closed position the cushion tip contacts the device and seats the device in the receptacle.

Embodiments described herein include a system including a mount comprising a receptacle. When a device is introduced to the mount the receptacle receives at least a portion of a device. The system includes a clamp attached to the mount and comprising a load arm rotateably coupled to a lever arm that controls the load arm between an open position and a closed position. The system includes a platform connected to the load arm. The system includes a plurality of spindles connected to the platform. When the device is present in the receptacle and the load arm is in the closed position the plurality of spindles contact the device and secure the device in the receptacle.

Embodiments described herein include a system comprising: a mount comprising a receptacle, wherein when a device is introduced to the mount the receptacle receives at least a portion of a device; a clamp attached to the mount and comprising a load arm rotateably coupled to a lever arm that controls the load arm between an open position and a closed position; a platform connected to the load arm; and a plurality of spindles connected to the platform, wherein when the device is present in the receptacle and the load arm is in the closed position the plurality of spindles contact the device and secure the device in the receptacle.

Embodiments described herein include a method for securing a device for calibration. The method comprises forming a mount as a pipe section having a receptacle. The pipe section has a length and a cylindrical cross-section with an inside diameter. When the device is introduced to the mount the receptacle receives at least a portion of a device. The method comprises forming a clamp by rotateably coupling a first arm to a second arm. The second arm controls the first arm between an open position and a closed position. The method comprises connecting a base of the clamp to the mount. The method comprises connecting a platform and a spindle to the first arm. The spindle includes a cushion tip on a distal end. The method comprises, when the device is present in the receptacle and the first arm is in the closed position, seating the device in the receptacle by contacting the device with the spindle.

Embodiments described herein include a method for securing a device for calibration, the method comprising: forming a mount as a pipe section having a receptacle, wherein the pipe section has a length and a cylindrical cross-section with an inside diameter, wherein when the device is introduced to the mount the receptacle receives at least a portion of a device; forming a clamp by rotateably coupling a first arm to a second arm, wherein the second arm controls the first arm between an open position and a closed position, and connecting a base of the clamp to the mount; connecting a platform and a spindle to the first arm, wherein the spindle includes a cushion tip on a distal end; and when the device is present in the receptacle and the first arm is in the closed position, seating the device in the receptacle by contacting the device with the spindle.

The components described herein can be components of a single system, multiple systems, and/or geographically separate systems. The components of an embodiment can also be subcomponents or subsystems of a single system, multiple systems, and/or geographically separate systems. The components of an embodiment can be coupled to one or more other components (not shown) of a host system or a system coupled to the host system.

The components of an embodiment include and/or run under and/or in association with a processing system. The processing system includes any collection of processor-based devices or computing devices operating together, or components of processing systems or devices, as is known in the art. For example, the processing system can include one or more of a portable computer, portable communication device operating in a communication network, and/or a network server. The portable computer can be any of a number and/or combination of devices selected from among personal computers, cellular telephones, personal digital assistants, portable computing devices, and portable communication devices, but is not so limited. The processing system can include components within a larger computer system.

The processing system of an embodiment includes at least one processor and at least one memory device or subsystem. The processing system can also include or be coupled to at least one database. The term "processor" as generally used herein refers to any logic processing unit, such as one or more central processing units (CPUs), digital signal processors (DSPs), application-specific integrated circuits (ASIC), etc. The processor and memory can be monolithically integrated onto a single chip, distributed among a number of chips or components of the AMS, and/or provided by some combination of algorithms. The AMS methods described herein can be implemented in one or more of software algorithm(s), programs, firmware, hardware, components, circuitry, in any combination.

The components of an embodiment can be located together or in separate locations. Communication paths couple the components and include any medium for communicating or transferring files among the components. The communication paths include wireless connections, wired connections, and hybrid wireless/wired connections. The communication paths also include couplings or connections to networks including local area networks (LANs), metropolitan area networks (MANs), wide area networks (WANs), proprietary networks, interoffice or backend networks, and the Internet. Furthermore, the communication paths include removable fixed mediums like floppy disks, hard disk drives, and CD-ROM disks, as well as flash RAM, Universal Serial Bus (USB) connections, RS-232 connections, telephone lines, buses, and electronic mail messages.

Aspects of the components of an embodiment described herein may be implemented as functionality programmed into any of a variety of circuitry, including programmable logic devices (PLDs), such as field programmable gate arrays (FPGAs), programmable array logic (PAL) devices, electrically programmable logic and memory devices and standard cell-based devices, as well as application specific integrated circuits (ASICs). Some other possibilities for implementing the components of an embodiment include: microcontrollers with memory (such as electronically erasable programmable read only memory (EEPROM)), embedded microprocessors, firmware, software, etc. Furthermore, aspects of the components may be embodied in microprocessors having software-based circuit emulation, discrete logic (sequential and combinatorial), custom devices, fuzzy (neural) logic, quantum devices, and hybrids of any of the above device types. Of course the underlying device technologies may be provided in a variety of component types, e.g., metal-oxide semiconductor field-effect transistor (MOSFET) technologies like complementary metal-oxide semiconductor (CMOS), bipolar technologies like emitter-coupled logic (ECL), polymer technologies (e.g., silicon-conjugated polymer and metal-conjugated polymer-metal structures), mixed analog and digital, etc.

Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import, when used in this application, refer to this application as a whole and not to any particular portions of this application. When the word "or" is used in reference to a list of two or more items, that word covers all of the following interpretations of the word: any of the items in the list, all of the items in the list and any combination of the items in the list.

The above description of embodiments is not intended to be exhaustive or to limit the systems and methods to the precise forms disclosed. While specific embodiments and examples are described herein for illustrative purposes, various equivalent modifications are possible within the scope of the systems and methods, as those skilled in the relevant art will recognize. The teachings of the embodiments provided herein can be applied to other systems and methods, not only for the systems and methods described above.

The elements and acts of the various embodiments described above can be combined to provide further embodiments. These and other changes can be made to the embodiments in light of the above detailed description.

What is claimed is:

1. A system comprising: a pipe comprising at least one section that spans between a first end and a second end of the pipe, wherein the pipe has a cylindrical cross-section; a mount comprising a receptacle positioned in the pipe a first distance from the first end and a second distance from the second end, wherein the receptacle receives a device having at least one microphone that is to be calibrated and secures the at least one microphone a third distance inside an inside surface of the pipe; a clamp attached to the mount and comprising a first arm rotateably coupled to a second arm that controls the first arm between an open position and a closed position; a platform and a spindle connected to the first arm, wherein the spindle includes a cushion tip on a distal end, wherein when the device is present in the receptacle and the first arm is in the closed position the cushion tip contacts the device and seats the device in the receptacle; and an adapter connected to the first end that connects a loudspeaker to the pipe, wherein the pipe controls an acoustic energy experienced by the plurality of microphones so that each microphone of the plurality of microphones receives equivalent acoustic energy.

2. The system of claim 1, wherein the mount comprises a pipe section having a length and an inside diameter, wherein the pipe section has a cylindrical cross-section.

3. The system of claim 2, wherein when the device is secured in the receptacle at least a portion of the device is positioned a first distance inside the pipe section.

4. The system of claim 1, wherein the receptacle includes a cutout that positions the device so that a first portion of the device is exposed to a first region adjacent to a first side of the mount and a second portion of the device is exposed to a second region adjacent to a second side of the mount.

5. The system of claim 1, wherein when the device is present in the receptacle and the first arm is in the closed position an attached position at which the clamp is attached to the mount results in the cushion tip pulling the device back toward a base of the clamp and securing the device in the receptacle.

6. The system of claim 1, wherein the clamp comprises a third arm rotateably connected to the first arm and to the second arm, wherein movement of the second arm is translated via the third arm to control the first arm between the open position and the closed position.

7. The system of claim 1, wherein the platform comprises a first surface having a first orifice that accepts the spindle.

8. The system of claim 1, comprising a calibration pipe and a loudspeaker connected to the mount.

9. The system of claim 8, wherein the device comprises at least one microphone, wherein the at least one microphone is calibrated while seated in the receptacle.

10. The system of claim 8, wherein the device comprises a plurality of microphones, wherein the receptacle locates each microphone of the plurality of microphones an equal distance from the loudspeaker and the plurality of microphones are calibrated while seated in the receptacle.

11. The system of claim 1, wherein the first distance is at least 30 centimeters.

12. The system of claim 1, wherein the second end is open.

13. The system of claim 1, wherein the second end is coupled to a cap, wherein the cap closes the second end.

14. The system of claim 1, wherein the at least one microphone comprises a plurality of microphones, wherein the receptacle locates each microphone of the plurality of microphones an equal distance from the loudspeaker.

15. The system of claim 1, comprising an absorbing material positioned inside at least a portion of the pipe.

16. The system of claim 1, wherein the loudspeaker is a mouth simulator loudspeaker.

* * * * *